US006589013B2

(12) United States Patent
Abdallah

(10) Patent No.: US 6,589,013 B2
(45) Date of Patent: Jul. 8, 2003

(54) FLUID FLOW CONTROLLER

(75) Inventor: Shaaban A. Abdallah, Cincinnati, OH (US)

(73) Assignee: Macro-Micro Devices, Inc., Dallas, TX (US)

( * ) Notice: Subject to any disclaimer, the term of this patent is extended or adjusted under 35 U.S.C. 154(b) by 64 days.

(21) Appl. No.: 09/792,110

(22) Filed: Feb. 23, 2001

(65) Prior Publication Data

US 2002/0119038 A1 Aug. 29, 2002

(51) Int. Cl.[7] ..... F04D 29/44
(52) U.S. Cl. ..... 415/199.2
(58) Field of Search ..... 415/199.1, 199.2, 415/199.3, 208.2, 62, 69; 416/183, 185, 188

(56) References Cited

U.S. PATENT DOCUMENTS

| | | | | |
|---|---|---|---|---|
| 1,427,391 A | | 8/1922 | Johns | |
| 2,333,150 A | * | 11/1943 | Bowen | 261/30 |
| 2,350,839 A | | 6/1944 | Szydlowski | |
| 2,398,203 A | | 4/1946 | Browne | |
| 3,065,954 A | | 11/1962 | Whitaker | |
| 3,104,050 A | | 9/1963 | Coward | |
| 3,112,708 A | | 12/1963 | Kaufmann | |
| 3,628,886 A | | 12/1971 | Andvig | |
| 3,918,841 A | | 11/1975 | Kida et al. | |
| 3,958,905 A | | 5/1976 | Wood | |
| 4,183,719 A | | 1/1980 | Bozung | |
| 4,361,414 A | | 11/1982 | Nemes et al. | |
| 4,400,134 A | | 8/1983 | Sweeney | |
| 4,502,837 A | | 3/1985 | Blair et al. | |
| 4,653,976 A | | 3/1987 | Blair et al. | |
| 5,213,473 A | | 5/1993 | Fiala | |

FOREIGN PATENT DOCUMENTS

| | | |
|---|---|---|
| AT | 364 874 | 8/1978 |
| DE | 1 039 694 | 9/1958 |
| EP | 0 080 251 | 6/1983 |
| EP | 0 348 342 | 12/1989 |
| FR | 972 751 | 2/1951 |
| FR | 2.044.341 | 2/1971 |
| GB | 2 071 765 | 9/1981 |

OTHER PUBLICATIONS

Cohen et al., *Gas Turbine Theory, 4th Ed.*, 1987, pp. 126–153, 167–169.

Sutton, *Rocket Propulsion Elements, An Introduction to the Engineering of Rockets, 6th Ed.*, 1992, pp. 327–331, 334–341.

International Search Report, application No. PCT/US 02/05436, mailed Jan. 23, 2003.

* cited by examiner

*Primary Examiner*—Edward K. Look
*Assistant Examiner*—Kimya N McCoy
(74) *Attorney, Agent, or Firm*—Kevin L. Daffer; Conley Rose P.C.

(57) ABSTRACT

A fluid flow controller and method of operation thereof are presented. The fluid flow controller may include a casing having a casing blade. The fluid flow controller may also include a rotor having a first rotor blade and a second rotor blade radially spaced from the first rotor blade. The rotor may be configured to rotate relative to, and preferably within, the casing such that the casing blade passes between the first and second rotor blades during use. Compared to conventional pumps or compressors, the present fluid flow controller may have an enhanced ability to accelerate (and possibly to subsequently pressurize) fluid flow. Thus, the need to use multiple stages may be reduced or eliminated.

58 Claims, 11 Drawing Sheets

FLUID FLOW CONTROLLER

BACKGROUND OF THE INVENTION

1. Field of the Invention

The present invention relates to fluid flow equipment, and more particularly, to fluid flow controlling equipment such as compressors and pumps.

2. Description of the Related Art

The information described below is not admitted to be prior art by virtue of its inclusion in this Background section.

Fluid flow controlling equipment ("fluid flow controllers") may be considered to include those apparatuses that are capable of controlling (e.g., pumping, compressing) fluid flow (e.g., liquids, gases, combinations thereof). Two of the most important types of fluid flow controllers are pumps and compressors. Pumps are fluid flow controllers that may be used to raise and/or transfer fluids, often by pressure or suction. Compressors are fluid flow controllers that may be used to increase the pressure of a fluid (typically gases). There are several types of pumps and compressors. Many compressors and pumps have overlapping characteristics (e.g., many types of each are similar in design), and thus the device types are usually distinguished by their primary intended use.

One particularly important type of compressor is the centrifugal compressor. Centrifugal compressors typically operate by accelerating a fluid introduced into the compressor and then decelerating the fluid to induce a rise in the fluid static pressure. The principle of operation behind a centrifugal compressor is similar to that of a centrifugal pump; the difference is essentially in the nature of the fluids operated on by each device. Centrifugal compressors are often preferred over other compressor types because of their potential for smaller size and greater pressure rise.

Centrifugal compressors typically include an impeller, or rotor, positioned within a stationary casing (e.g., a stator). In a typical centrifugal compressor configuration, the rotor is essentially a wheel with curved vanes, or blades. The blades extend from the hub of the rotor to the tip of the rotor. The hub of the rotor has hub opening that extends through the rotor. A shaft for rotating the rotor within the casing extends through the hub and is attached to the rotor. During operation, fluid flow typically enters a centrifugal compressor in a direction substantially parallel to the rotational axis of the rotor, and exits the rotor in a direction substantially perpendicular to the rotational axis of the rotor. By appropriately rotating the rotor within the casing, the blades of the rotor may accelerate fluid fed into the compressor, allowing the fluid to exit the rotor with increased velocity (and possibly pressure). The accelerated fluid may then be directed into a collector (e.g., a volute). From the collector, the accelerated fluid may enter a diffuser where the fluid is slowed, allowing further conversion from kinetic energy (velocity) to potential energy (pressure) to occur.

In a centrifugal compressor, the degree of fluid flow acceleration is largely affected by the orientation of the blades on the rotor. Generally speaking, rotor blades can be oriented in radial, forward (flow directed into the direction of rotation), or backwards (flow directed opposite the direction of rotation) orientations. By orienting the blades in a particular manner, and by otherwise molding the rotor blades into particular shapes (e.g., twisting or leaning the blades), fluid directed into a compressor can be turned a certain way by the rotor and a desired degree of fluid acceleration can be obtained.

Unfortunately, the extent to which the orientation of rotor blades may be effectively manipulated to enhance fluid flow acceleration is limited. As noted above, conventional compressor blades may extend from a point proximal the hub of the rotor to a point proximal the rotor tip. When attempting to accelerate fluid with such blades, the rotated fluid preferably follows a blade or blades of the rotor for the length of the blade(s). That is, in an ideal centrifugal compressor entering fluid travels along a blade from the inner edge of a blade to the outer edge of the blade before exiting the rotor into the collector. If, however, the angles of the rotor blades are too large, and the rotated fluid is turned to an excessive degree (given a variety of fluid and compressor parameters), then the fluid may not follow (e.g., may separate from) the rotor blades. The separated fluid may increase the turbulence of the fluid sent into the collector, making the fluid flow more difficult to handle efficiently. Such a situation may undesirably prevent the desired degree of acceleration (and thus pressurization) from being achieved.

In an attempt to circumvent this problem, many compressor designers are forced to abandon more compact, single stage designs in favor of larger, multiple stage designs. Multiple stage compressors typically include multiple rotors arranged in series to obtain greater pressure rises than may usually be obtainable from single stage compressors using the same type of rotor. Because such multiple stage compressors are larger, however, one of the advantages of using a centrifugal pump may be reduced or lost. In addition, the efficient transport of an accelerated fluid from one stage to another is difficult, and thus the efficiency of multiple stage compressors is often less than a similarly configured single stage compressor.

Therefore, it would be desirable to develop a fluid flow controller, e.g., a compressor or pump, which has an enhanced ability to accelerate fluid flow. Such a fluid flow controller should reduce or eliminate the need to use multiple stages to achieve a desired degree of performance.

SUMMARY

The problems described above may be in large part addressed by the present fluid flow controller and method of operation thereof. The fluid flow controller may include a casing having a casing blade. The fluid flow controller may also include a rotor including a first rotor blade and a second rotor blade. The first and second rotor blades are preferably truncated such that they are radially spaced from each other. That is, the first and second rotor blades preferably do not extend the length of the rotor (e.g., from the hub of the rotor to the tip of the rotor) as do many conventional blades, but instead each extend to radially spaced points along the rotor. The casing blade is preferably also a truncated blade having a length less than the radial spacing between the first and second rotor blades. Thus, the rotor may be configured to rotate relative to, and preferably within, the casing such that the casing blade passes between the first and second rotor blades during use.

Compared to conventional pumps or compressors, the present fluid flow controller may have an enhanced ability to accelerate (and possibly to subsequently pressurize) fluid flow. As noted above, when the angles of a rotor blade become too extreme, and the rotated fluid is turned to an excessive degree (given a variety of fluid and controller parameters), the fluid may not follow the rotor blades and the desired degree of acceleration may not be obtained. In addition, the maximum extent to which rotor blades may efficiently turn fluid flow is influenced by the length of the blades. Thus, the maximum degree to which each truncated blade can turn or accelerate fluid flow may be slightly less than that of a conventional rotor blade that extends from the rotor hub to the rotor tip. But since the number of discrete blades on the rotor and casing may be significantly increased over conventional designs, the present fluid flow controller may provide greater fluid flow acceleration.

One reason for this benefit may be that each blade of the present fluid flow controller (whether on the casing or the rotor) may be configured specifically for the flow characteristics it is expected to encounter during operation. Further, instead of having to be turned by, and thus follow, one long, continuous blade over its entire length, fluid flow may instead be turned by several discrete blades in series. In addition, because of the presence of the casing blades between the rotor blades, the velocity of fluid flow leaving a first rotor blade may have no necessary relationship to the velocity of fluid flow entering a second radially spaced rotor blade (e.g., the casing blade may turn fluid flow to a different direction and/or velocity than it had leaving the first rotor blade). Thus, the orientation of the second rotor blade may not be limited by the orientation of the first rotor blade. By configuring the blades appropriately, the sum acceleration imparted by the series of rotor and casing blades may be significantly greater than that provided by a single continuous blade. Beneficially, such increased acceleration may reduce or avoid the need to resort to multiple stage designs when, e.g., very large pressure rises are desired.

In an embodiment, the fluid flow controller may include a centrifugal pump or compressor having a casing in which a rotor is configured to rotate. The casing may have at least one casing blade, and preferably has a plurality of casing blades. The fluid flow controller may further include a rotor. The rotor may also include at least first and second radially spaced rotor blades. Preferably, the rotor includes a first plurality (e.g., a first row) of rotor blades and a second plurality (e.g., a second row) of rotor blades radially spaced from the first row of rotor blades. The rotor may be positioned within the casing, and may be configured to rotate within the casing such that each of the casing blades passes between the first and second plurality of rotor blades during use. That is, the rotor blades may, by rotation of the rotor to which they are attached, rotate around the casing blades such that at some point in time each of the casing blades is positioned between a rotor blade from each plurality of rotor blades. The first and second pluralities of rotor blades may be further configured to turn and accelerate fluid flow. The casing blades may also be configured to turn and accelerate fluid flow. The casing blades may be located within the circumference (i.e., within the lateral boundaries of) the rotor.

During use, fluid flow may be introduced into the casing, within which the rotor may be positioned. The rotor may be rotated to accelerate the fluid flow. In an embodiment, the fluid flow may be turned by a first rotor blade from the first plurality of rotor blades, then by a casing blade, and then finally by a second rotor blade from the second plurality of rotor blades. As noted above, the amount of acceleration and/or compression imparted to a fluid passing through the rotor/casing assembly may consequently be much higher than is conventionally possible. The casing may be connected to a volute configured to collect fluid flow exiting the rotor, and further to diffuse the fluid flow (e.g., in a diffuser section) to induce a pressure rise therein. Fluid flow that has been accelerated and/or compressed by the rotor may subsequently pass into the volute and out the volute exit, to be used in whatever manner desired.

In a preferred embodiment, the rotor may have a hub configured to receive a shaft for rotating the rotor. The hub may include a hub opening through which the shaft may extend. The hub may protrude from a base of the rotor (e.g., the bottommost portion of the rotor), and preferably widens as it approaches the rotor base. The first plurality of rotor blades may be arranged closer to a center of the hub than the second plurality of rotor blades. The casing blades are preferably sized such that they are thinner than the minimum radial spacing between the first and second plurality of rotor blades. Thus, the casing blades may pass between the first and second plurality of rotor blades during rotation of the rotor within the casing.

Preferably, the rotor is a centrifugal or mixed flow (i.e., between axial and centrifugal) rotor. Thus, the rotor is preferably configured to accelerate fluid flow such that the predominant orientation of fluid flow exiting the rotor during use is angled away from and substantially oblique to the rotational axis of the rotor. That is, the majority of fluid flow exiting the rotor during use may have an orientation angled away from the rotational axis of the rotor by an amount greater than 5, and preferably greater than 10, degrees. More preferably, the rotor may be configured to accelerate fluid flow such that the predominant orientation of fluid flow exiting the rotor during use is substantially perpendicular to the rotational axis of the rotor (e.g., within 10, and preferably 5, degrees of perpendicular).

To achieve the flow characteristics described above, the rotor may be shaped such that the diameter of the hub increases from the top of the hub to the rotor base. Consequently, the hub may have a sloped or curved surface beneath the rotor blades that, when travelling from a point near the center of the hub to the tip of the rotor, starts in a orientation substantially parallel to the rotational axis of the rotor, and ends in a orientation substantially perpendicular to the rotational axis of the rotor. In an embodiment, each of the rotor blades may include an outer end and an inner end closer to the center of the hub than the outer end. The rotor may thus be configured such that a diameter of the rotor at a point proximal to the inner ends of the second plurality of rotor blades is greater than a diameter of the rotor proximal to the inner ends of the first plurality of rotor blades. More preferably, a diameter of the rotor at a point proximal to the inner ends of the first plurality of rotor blades may be less than a diameter of the rotor at a point proximal to the respective outer ends of the first plurality of rotor blades. Further, a diameter of the rotor at a point proximal to the inner ends of the second plurality of rotor blades may be less than a diameter of the rotor at a point proximal to the respective outer ends of the second plurality of rotor blades.

Consequently, the fluid flow controller may include a fluid flow path defined between the casing and the rotor that is preferably substantially parallel to the axis of rotation of the rotor at the inlet of the fluid flow path and is preferably substantially perpendicular to the axis of rotation of the rotor at the outlet of the fluid flow path. The inlet of the fluid flow path may be an opening in the casing defined above the center of the rotor hub, and the outlet of the fluid flow path may be located near the tip of the rotor. At the outlet of the fluid flow path, the accelerated and/or compressed fluid may have a substantially radial, or centrifugal, orientation.

Preferably, the casing blades are closely positioned between blades of the first and second rows of rotor blades during use. Consequently, the spacing between the casing blades and the rotor blades, and between the casing blades and the rotor surface, as a casing blade passes between the first and second row of rotor blades may be relatively small.

In an embodiment, the spacing between the casing blades and the rotor surface may be approximately equivalent to the spacing between the rotor blades and the casing surface from which the casing blades extend.

In other embodiments, the fluid flow controller could incorporate different numbers of blades in the first and second rows of rotor blades. The casing could also contain more or fewer casing blades than either row of rotor blades. The rotor and casing blades can be angled in a variety of manners (e.g., radially, forward, or backwards), and can be angled in different directions even within the same cohort of blades. The ability to vary the number and orientation of blades in the casing and/or the rotor to any desired degree (depending on the expected fluid flow conditions and the desired outcome) may allow for further enhancement of the efficiency of the present fluid flow controller. Embodiments showing specific potential variations will be explained in more detail below.

In addition, a dual rotor design is presented in which the rotor is configured as a rotor assembly having a first rotor and a second rotor configured to independently rotate. The first rotor may have a first rotor blade, and the second rotor may have a second rotor blade. The second rotor preferably has a diameter greater than the first rotor. Preferably, the first rotor is positionable at least partially within the lateral boundaries of the second rotor such that the first rotor blade is radially spaced from the second rotor blade. In an embodiment, the rotor assembly may be configured to accelerate fluid flow such that the predominant orientation of fluid flow exiting the rotor assembly during use is angled away from and substantially oblique to, and more preferably substantially perpendicular to, a rotational axis of the rotor assembly.

A fluid flow controller including such a rotor assembly may have several advantages. In addition to the features and benefits of the embodiments described above, a dual rotor assembly may allow the rotational speed of the rotor blades on each rotor to be independently set to a speed dependent on the specific needs of that row. In an embodiment, the first rotor and the second rotor may each be attached to separate and possibly concentric shafts, allowing the first and second rotors to be rotated at different velocities. For example, the second, outer rotor may be rotated at a lower speed than the first, inner rotor, potentially improving the efficiency of the fluid flow controller. In addition, the first and second rotors may be rotated in opposite directions.

BRIEF DESCRIPTION OF THE DRAWINGS

Other objects and advantages of the invention will become apparent upon reading the following detailed description and upon reference to the accompanying drawings in which.

Figure 1A:
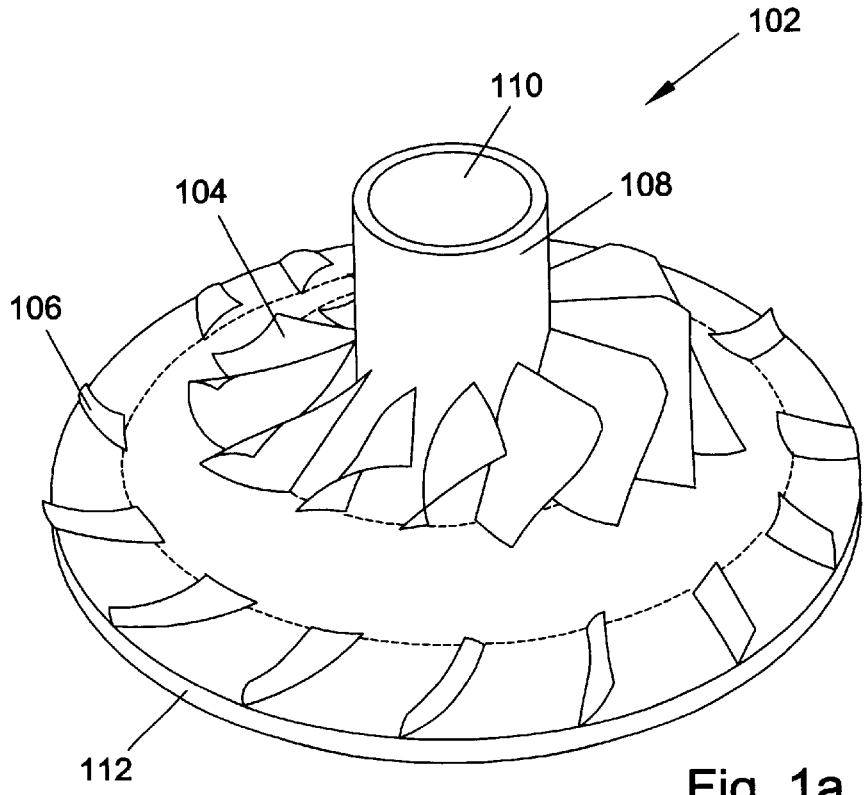
FIG. 1*a* is a perspective view of a rotor having first and second rows of radially spaced, truncated rotor blades in accordance with an embodiment.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

FIG. 1*a* presents a perspective view of a rotor 102. Rotor 102 preferably includes a first row of rotor blades 104 and a second row of rotor blades 106. Rotor 102 may also include a hub 108 configured to receive a shaft for rotating rotor 102. Hub 108 may include an opening 110 through which the shaft may extend. Thus, the rotational axis of rotor 102 during use may extend through the center of hub 108.

Hub 108 may protrude from a base of rotor 102 (e.g., the bottommost portion of the rotor), and preferably widens as it approaches the rotor base, terminating at rotor tip 112.

First and second rows of rotor blades 104 and 106 each may include several truncated and radially spaced rotor blades. That is, the blades of the first and second rows of rotor blades preferably do not extend the length of rotor 102 (e.g., from hub 108 to tip 112) as do many conventional blades, but instead each extend to radially spaced points along the rotor. Thus, second row of rotor blades 106 may be spaced further away from the center of the hub 108 along the radius of rotor 102 than first row of rotor blades 104. The radial spacing between the rows of rotor blades is preferably significant; in an embodiment, the radial spacing between rows is at least one-third to one-half of the length of blades of either row of rotor blades. Such spacing may ensure sufficient clearance for an appropriately sized casing blade to pass between first row 104 and second row 106 during rotation of rotor 102 relative to, and preferably within, a casing. Rotor 102 is preferably circular, and thus rotor blades of both rows of rotor blades may extend around the rotor in a circular arrangement. Rotor 102 is shown in FIG. 1 as contiguous, single structure apparatus, but may alternately be constructed of several, possibly individually movable pieces.

As shown in FIG. 1, blades of first row of rotor blades 104 are preferably arranged closer to the center of hub 108 than blades of second row of rotor blades 106. Blades of rotor 102 may generally be significantly thinner than they are tall. Furthermore, blades of rotor 102 may be twisted, leaned, and/or rotationally oriented in accordance with desired performance results for rotor 102 (and possibly taking account the shape of the casing and casing blades it may be used with). There is no required length or size relationship between blades of either row. Additional information on the general design principles of rotor blades may be found U.S. Pat. Nos. 4,502,837 and 4,6653,976 to Blair et al., the disclosures of which are incorporated herein by reference.

Rotor 102 may be a centrifugal rotor for use in a centrifugal pump or compressor. Thus, rotor 102 is preferably configured to accelerate fluid flow such that the predominant orientation of fluid flow exiting the rotor during use is angled away from and substantially oblique to the rotational axis of rotor 102. That is, the majority of fluid flow exiting rotor 102 during use may have an orientation angled away from the rotational axis of the rotor by an amount greater than 5, and preferably greater than 10, degrees. More preferably, rotor 102 may be configured to accelerate fluid flow such that the predominant orientation of fluid flow exiting the rotor during use is substantially perpendicular to the rotational axis of the rotor (e.g., within 10, and preferably 5, degrees of perpendicular).

To achieve the flow characteristics described above, rotor 102 is preferably shaped such that the diameter of the hub increases significantly from the top of hub 108 to the rotor base. (It should be noted that hub 108 may extend from the rotor base significantly further than is shown in FIG. 1.) Consequently, hub 108 may have a sloped or curved surface beneath rotor blades 104 and 106 that, when travelling from a point near the center of hub 108 to rotor tip 112, starts in a orientation substantially parallel to the rotational axis of the rotor, and ends in a orientation substantially perpendicular to the rotational axis of rotor 102. Accordingly, each of rotor blades 104 and 106 includes, in an embodiment, an outer end and an inner end arranged radially closer to the center of the hub than the outer end. Rotor 102 may thus be configured such that a diameter of rotor 102 at a point proximal to the inner ends of the second row of rotor blades 106 is greater than a diameter of the rotor proximal to the inner ends of the first row of rotor blades 104. More preferably, a diameter of rotor 102 at a point proximal to the inner ends of blades of first row of rotor blades 104 may be less than a diameter of the rotor at a point proximal to the respective outer ends of blades of first row of rotor blades 104. Further, a diameter of rotor 102 at a point proximal to the inner ends of blades of second row of rotor blades 106 may be less than a diameter of the rotor at a point proximal to the outer ends of blades of second row of rotor blades 106. In addition, a diameter of rotor 102 proximal to midpoints of each of second row of rotor blades 106 may be greater than a diameter of rotor 102 proximal to midpoints of each of first row of rotor blades 104.

Figure 1B:
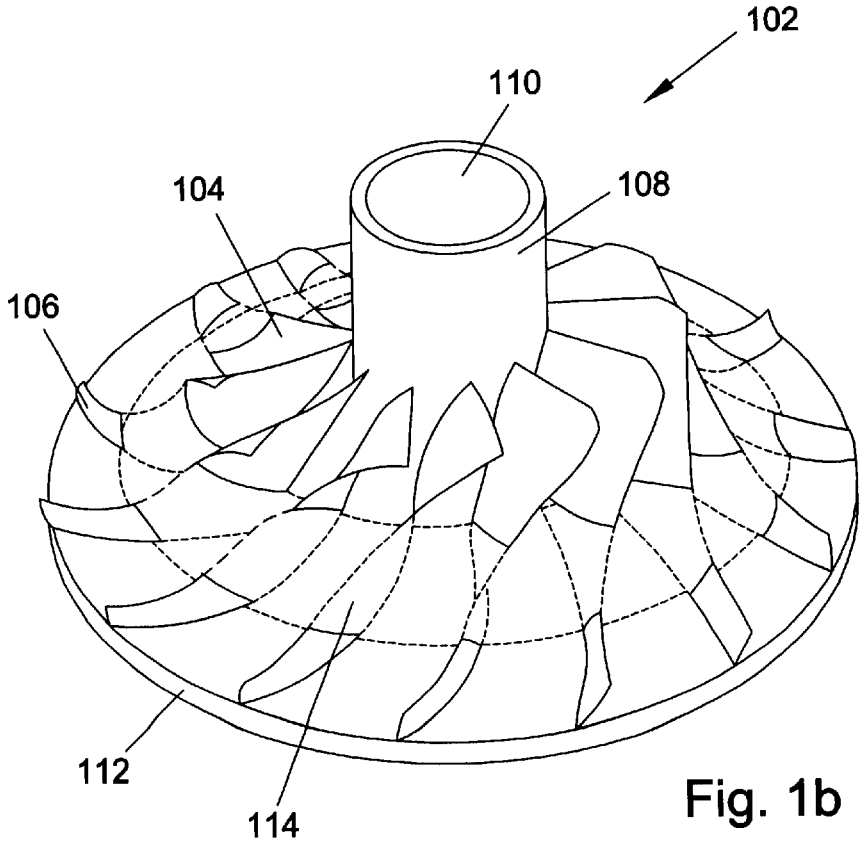
FIG. 1*b* is a perspective view of the rotor of FIG. 1*a*, in which a possible relationship between the rotor blades of each row of rotor blades is illustrated.

FIG. 1*b* presents a perspective view of rotor 102, in which a possible relationship between the rotor blades of each row of rotor blades is illustrated. More specifically, FIG. 1*b* shows a manner in which corresponding proximal ones of first and second rows of rotor blades 104 and 106 may be aligned in the shape of a conventional full-length blade from which a central section 114 (shown in shadow) is removed. Thus, the present rotor may be produced by retrofitting previous rotor designs to remove a central section of the rotor blades to produce first and second rows of rotor blades radially spaced such that a casing blade may pass therebetween. But because of the above-mentioned benefits of the present rotor design, a rotor redesigned in such a manner could be made smaller and more efficient. Alternately, a redesigned rotor could be used to create greater, e.g., pressure rise, from a rotor of the same size. As will be shown in more detail below, however, there is no requirement for any specific and consistent relationship to exist between individual blades of each row, and there may be more or fewer blades in any row than in any other row.

Figure 2:
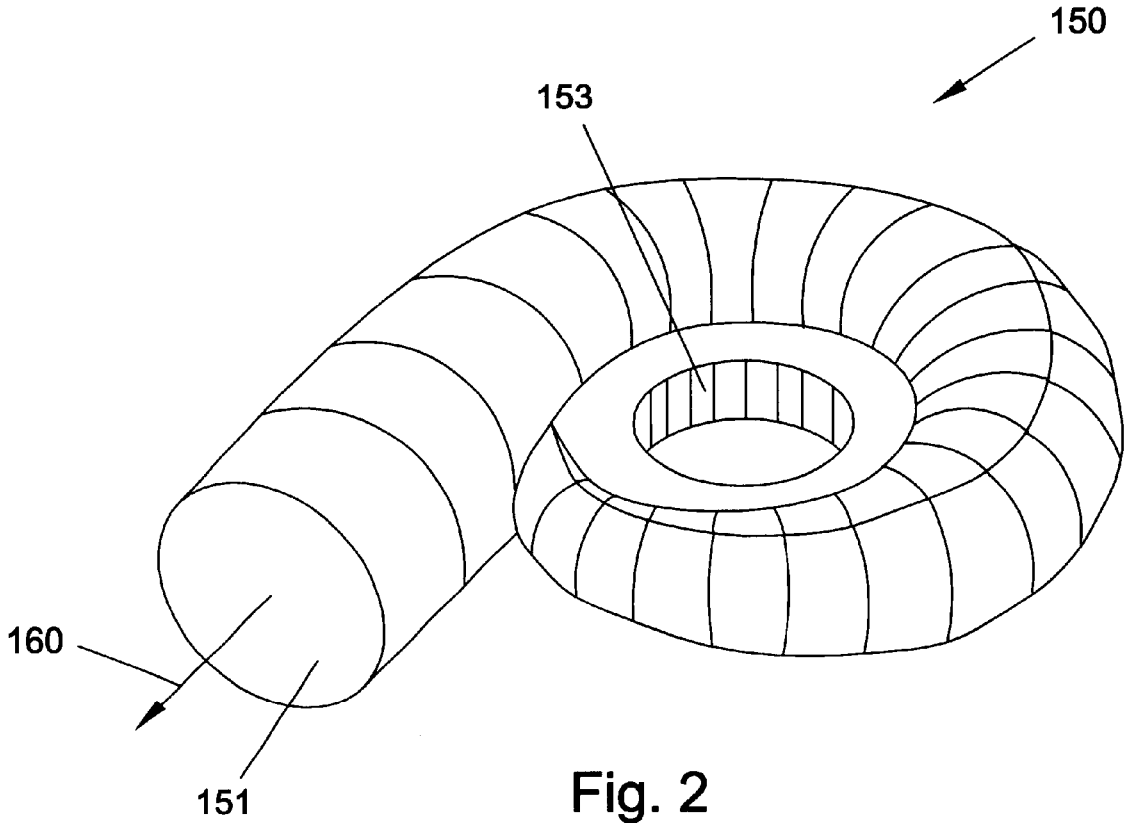
FIG. 2 is a perspective view of a volute configured to collect and diffuse fluid flow exiting a rotor in an embodiment.

FIG. 2 presents a perspective view of a volute 150. Volute 150 may include volute passageway entrances 153 that provide fluid flow entry into a scroll-shaped housing terminating in volute exit 151. In an embodiment in which rotor 102 is used as part of a centrifugal compressor, volute 150 may serve as a collector and diffuser of fluid flow exiting rotor 102. Rotor 102 may be positioned in the center of volute 150 and covered with a casing, preferably having one or more casing blades as described above. Fluid flow exiting rotor 102 may be collected into entrances 153, and diffused in a diffuser section of volute 150 to induce a pressure rise in the fluid flow. Such diffusion may occur via through a conversion from kinetic energy to potential energy via, e.g., expansion of passageway diameter and/or particularly shaped diffuser vanes. The pressurized fluid flow may exit through volute exit 151, to be used in whatever manner desired. While rotor 102 may be used with a variety of collector/diffuser structures, the specific construction of which is not believed to be critical, volute 150 is presented as an illustrative example.

Figure 3:
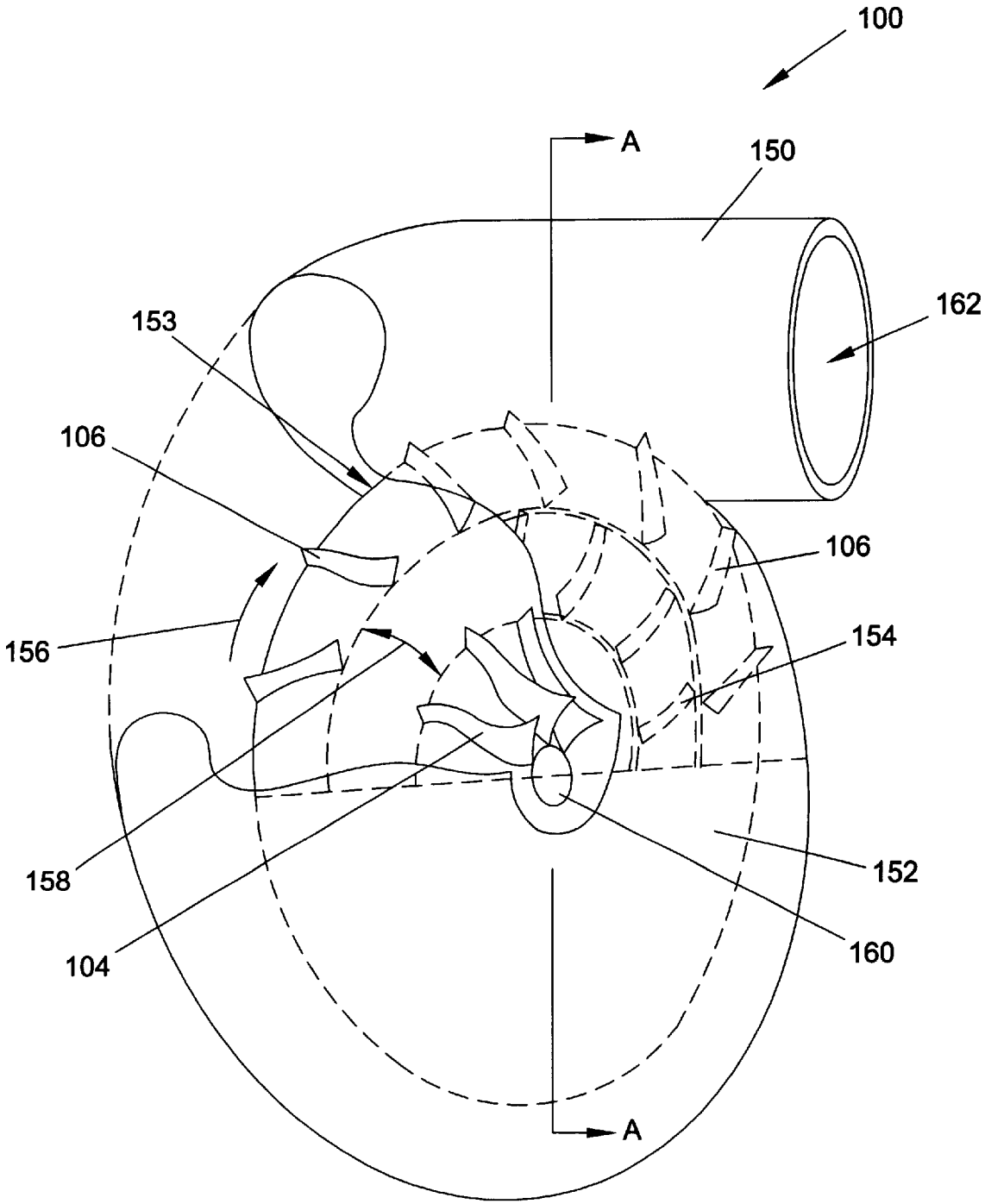
FIG. 3 is a cut-away partial perspective view of a fluid flow controller, in which a rotor as shown in FIG. 1*a* is positioned within a volute as shown in FIG. 2, the volute including a casing in which the rotor may rotate.

FIG. 3 is a cut-away partial perspective view of a fluid flow controller 100. Fluid flow controller 100 may include a centrifugal compressor having rotor 102 positioned within casing 152 of volute 150. Casing 152 may have at least one casing blade, and preferably has several casing blades 154. Casing blades preferably extend from an inner surface of casing 152 in a circular arrangement.

Rotor 102 is preferably configured to rotate within casing 152 in rotational direction 156 around a rotational axis extending entirely through hub 108. FIG. 3 illustrates a radial spacing 158 between first row of rotor blades 104 and second row of rotor blades 106. Casing blades 154 are preferably truncated blades having a length less than radial spacing 158 such that the casing blades may freely pass between the first and second rows of rotor blades during rotation of rotor 102 within casing 152. Accordingly, casing blades 154 may be located within the circumference (i.e., within the lateral boundaries of) rotor 102.

First and second rows of rotor blades 104 and 106 may be further configured to turn and accelerate fluid flow. Casing blades 154 may also be configured to turn and accelerate fluid flow. (Alternately, however, either row of rotor blades and/or the casing blades may be configured to decelerate fluid flow, to potentially increase the fraction of the overall pressure rise that occurs in a particular section of the rotor/casing assembly.) Beneficially, each blade of fluid flow controller 100, whether on casing 152 or rotor 102, may be configured specifically for the flow characteristics it is expected to encounter during operation. Further, instead of having to be turned by, and thus follow, one long, continuous blade over its entire length, fluid flow may be turned by several discrete blades in series. As a result of the presence of casing blades 154, the velocity of fluid flow leaving blades of first row of rotor blades 104 may have no necessary relationship to the velocity of fluid flow entering second row 106 (e.g., casing blades 154 may turn fluid flow to a different direction and/or velocity than it had leaving first row of rotor blades 104). Thus, the orientation of blades of second row of rotor blades 106 may not be limited by the orientation of blades of first row of rotor blades 104. By configuring the rotor and casing blades appropriately, the sum acceleration imparted by the series of rotor and casing blades may be significantly greater than that provided by a single continuous blade.

Fluid flow controller 100 also includes a casing entrance 160 (e.g., an eye) to allow fluid flow to be introduced into casing 152. Casing entrance 160 may be an opening in casing 152 defined above the center of hub 108. Several fluid flow paths may be defined between the casing and rotor from casing entrance 160 to volute passageway entrances 153. At least one of these fluid flow paths may be substantially parallel to the axis of rotation of rotor 102 at the inlet of the fluid flow path and substantially perpendicular to the axis of rotation of rotor 102 at the outlet of the fluid flow path. The inlet of the fluid flow path may be casing entrance 160, and the outlet of the fluid flow path may be located near rotor tip 112. At the outlet of the fluid flow path, the accelerated and/or compressed fluid may have a substantially radial, or centrifugal, orientation.

During use, fluid flow may be introduced into casing 152 through casing opening 160. Rotor 102 may be rotated to accelerate the fluid flow. (Rotation of rotor 102 may be initiated before or after introduction of fluid flow into casing 152.) Rotor 102 is preferably rotated such that each of casing blades 154 pass between first row of rotor blades 104 and second row of rotor blades 106. In an embodiment, the entering fluid flow may be turned by a first rotor blade from first row of rotor blades 104, then by a casing blade of casing blades 154, and then finally by a second rotor blade from second row of rotor blades 106. As noted above, the amount of acceleration and/or compression imparted to a fluid passing through the rotor/casing assembly of fluid flow controller 100 may consequently be much higher than is conventionally possible.

Because of the design of rotor 102 described above, rotation of rotor 102 in rotational direction 156 may accelerate fluid flow such that the predominant orientation of the fluid flow exiting rotor 102 is substantially oblique to the rotational axis of the rotor. More preferably, rotation of rotor 102 in rotational direction 156 may accelerate fluid flow such that the predominant orientation of the fluid flow exiting rotor 102 is substantially perpendicular to the rotational axis of the rotor. Rotation of rotor 102 may be imparted by a shaft (e.g., shaft 170 shown in FIG. 4) extending through hub 108 of the rotor.

Fluid flow exiting rotor 102 may enter volute 150 through volute passageway entrances 153. Volute 150 is only partially shown in FIG. 3, and thus fluid flow may exit through opening 162 (which may exist only as a cross-section of volute 150) into the remaining portions of the volute. It should be noted that fluid flow controller 100 may be configured such that the pressure rise imparted to fluid flow may be divided between each row of blades (rotor and casing) and the volute as desired.

Figure 4:
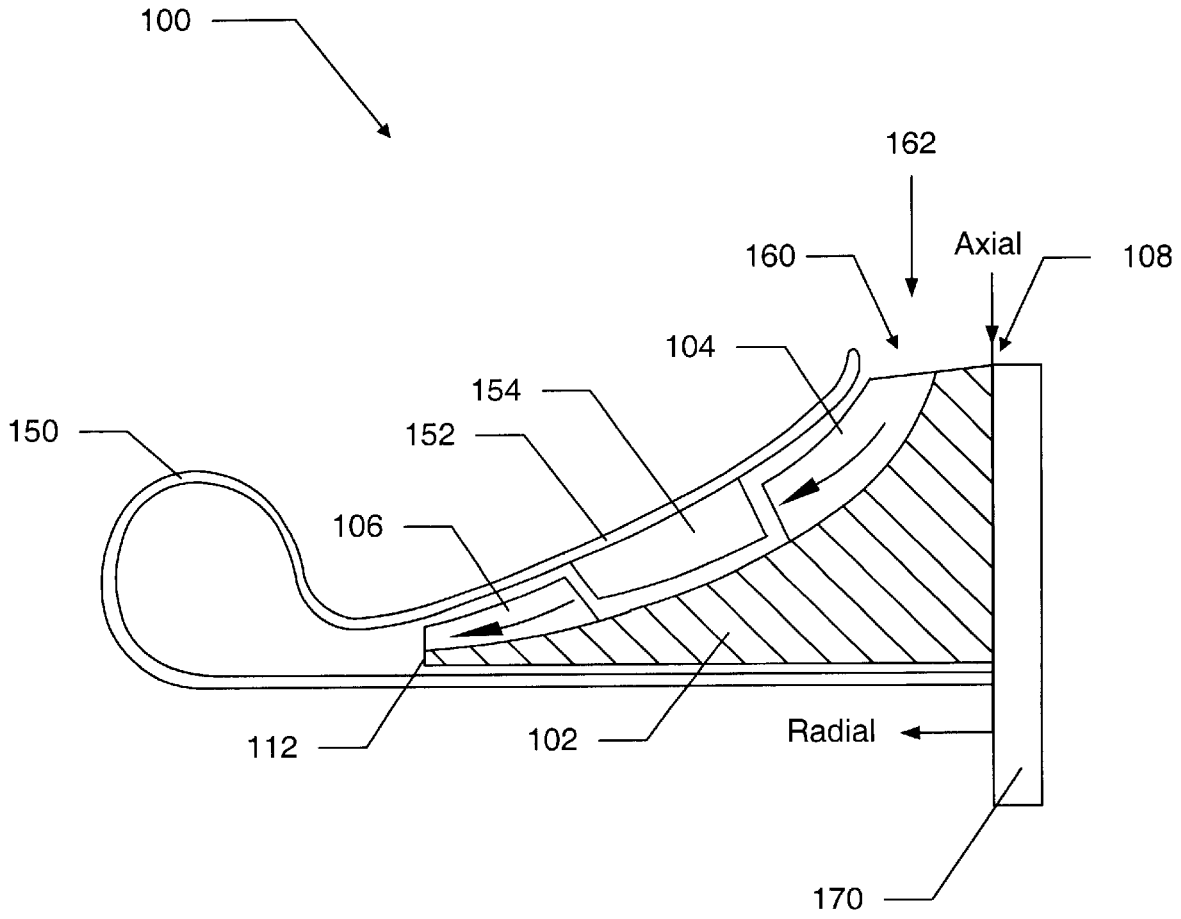
FIG. 4 is a partial cross-sectional view along axis A of the fluid flow controller shown in FIG. 3, in which a casing blade is shown closely positioned between first and second spaced rotor blades during use.

FIG. 4 presents a partial cross-sectional view along axis A of fluid flow controller 100. As shown in FIG. 4, casing blades 154 may be closely positioned between blades of first row of rotor blades 104 and blades of second row of rotor blades 106 during use. Consequently, the spacing between casing blades 154 and rotor blades 104 and 106, and between casing blades 154 and the surface of rotor 102, as a casing blade passes between the first and second row of rotor blades may be relatively small. In an embodiment, the spacing between the casing blades and the rotor surface may be approximately equivalent to the spacing between the rotor blades and the casing surface from which the casing blades extend. Stated otherwise, rotor 102 is preferably positionable within casing 152 such that casing blades 154 extend laterally between first and second rows of rotor blades 104 and 106 to a point proximal to the surface of rotor 102 during rotation of the rotor within the casing. In an embodiment, casing blades 154 may extend to a point spaced from the rotor surface less than one-fourth the height of blades of either row of rotor blades.

FIG. 4 shows shaft 170 attached to an inner surface of hub 108. Shaft 170 may impart rotation to rotor 102 around a rotational axis extending through the center of shaft 170, and thus preferably through the center of hub 108. As noted with regard to FIG. 3, fluid flow 162 may be introduced into casing 152 through entrance 160 during use. Fluid flow 162 may travel along a fluid flow path between casing 152 and rotor 102. The fluid flow path may have an inlet above a casing entrance 160 and may have an outlet near rotor tip 112 and proximal to one of volute entrances 153 (not shown in FIG. 4) of volute 150. The fluid flow path for fluid flow 162 may be substantially parallel to the rotational axis of rotor 102 at the inlet of the fluid flow path (e.g., in an "Axial" direction as shown in FIG. 4) and substantially perpendicular to the rotational axis of rotor 102 at the outlet of the fluid flow path (e.g., in a "Radial" direction as shown in FIG. 4). Consequently, fluid flow 162 exiting over tip 112 of rotor 102 may have a substantially radial, or centrifugal, orientation.

Figure 5:
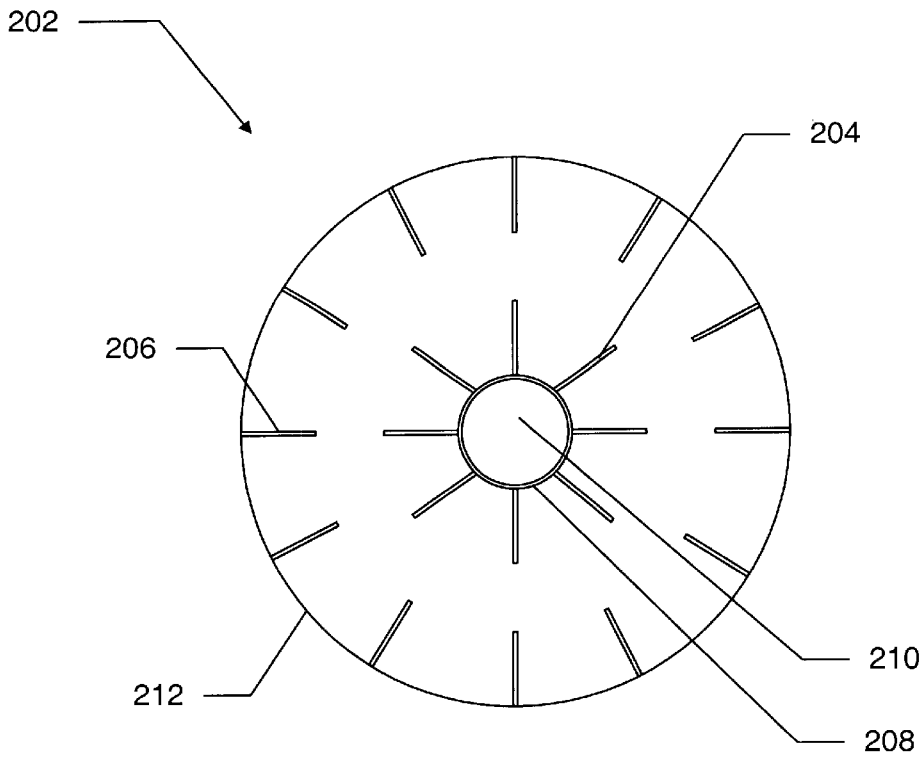
FIG. 5 is a top view of a rotor having a first row and a second row of radially oriented rotor blades in accordance with another embodiment.

FIG. 5 presents a top view of a rotor 202 in accordance with another embodiment. Rotor 202 preferably includes a first row of rotor blades 204 and a second row of rotor blades 206. Rotor 202 may also include a hub 208 configured to receive a shaft for rotating rotor 202. Hub 208 may include an opening 210 through which the shaft may extend. Thus, the rotational axis of rotor 202 during use may extend through the center of hub 208. Hub 208 may protrude from a base of rotor 202 (e.g., the bottommost portion of the rotor), and preferably widens as it approaches the rotor base, terminating at rotor tip 212. Components shown in FIG. 5 having similar reference numerals as components shown in FIG. 1*a* may be constructed similarly, may perform in a similar manner, and may be operated in a similar manner as their counterpart components from FIG. 1*a* (e.g., hub 208 may function similarly to hub 108, and first row of rotor blades 204 may be composed of the same materials as first row of rotor blades 104). Appropriate modifications may be made, however, to the design, function, and/or operation of each element in accordance with the particular conditions of the relevant embodiment, at least some of which are described below.

As noted above, rotor blades may generally be oriented in radial, forward (flow directed into the direction of rotation), or backwards (flow directed opposite the direction of rotation) orientations. As shown in FIG. 5, first row of rotor blades 204 and second row of rotor blades 206 may each include blades having a radial orientation. That is, rotor blades of both rows preferably direct fluid flow substantially along the radius of rotor 202 and not significantly into or away from the direction in which rotor 202 is rotated. Each of the blades of first and second rows of rotor blades 204 and 206 may have the same rotational orientation. That is, while the blades of either row are not required to have the precisely same degree of rotational orientation, they do preferably have the same general rotational orientation. Blades of rotor 202 may also be twisted and/or leaned as desired.

Generally speaking, it may be desirable to have at least as many or more rotor blades in rotor blade rows spaced further from the center of the rotor hub than those spaced closer. As such, FIG. 5 presents an embodiment in which second row of rotor blades 206 includes more rotor blades than first row of rotor blades 204.

Figure 6:
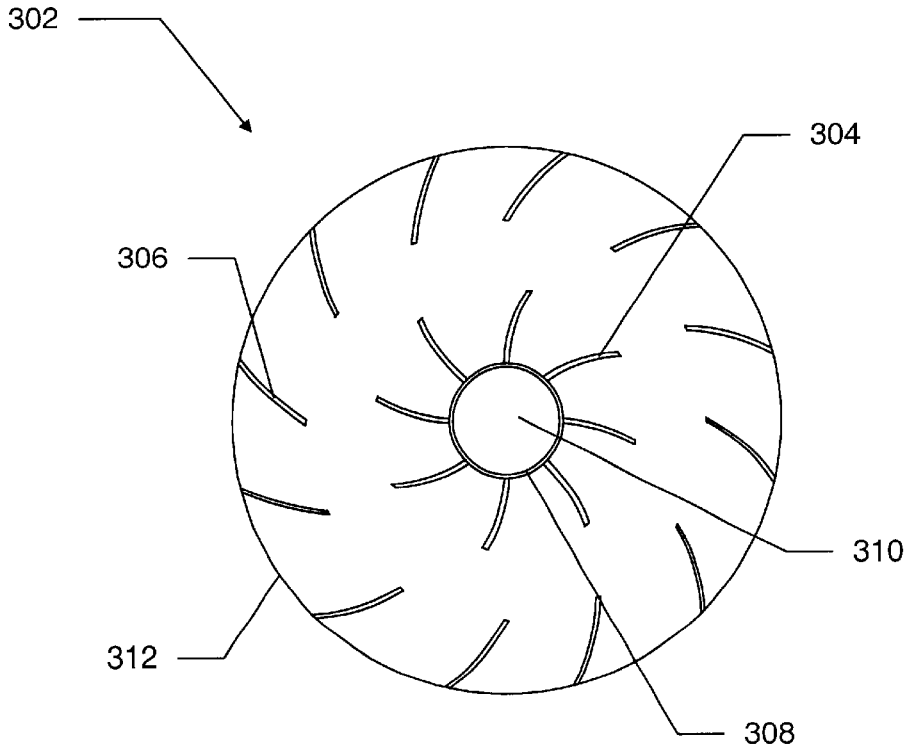
FIG. 6 is a top view of a rotor having a first row and a second row of rotor blades, in which the first and second row of rotor blades are oriented in the same rotational orientation in accordance with another embodiment.

FIG. 6 presents a top view of a rotor 302 in accordance with another embodiment. Rotor 302 preferably includes a first row of rotor blades 304 and a second row of rotor blades 306. Rotor 302 may also include a hub 308 configured to receive a shaft for rotating rotor 302. Hub 308 may include an opening 310 through which the shaft may extend. Thus, the rotational axis of rotor 302 during use may extend through the center of hub 308. Hub 308 may protrude from a base of rotor 302 (e.g., the bottommost portion of the rotor), and preferably widens as it approaches the rotor base, terminating at rotor tip 312. Components shown in FIG. 6 having similar reference numerals as components shown in FIG. 1*a* may be constructed similarly, may perform in a similar manner, and may be operated in a similar manner as their counterpart components from FIG. 1*a* (e.g., hub 308 may function similarly to hub 108, and first row of rotor blades 304 may be composed of the same materials as first row of rotor blades 104). Appropriate modifications may be made, however, to the design, function, and/or operation of each element in accordance with the particular conditions of the relevant embodiment, at least some of which are described below.

As shown in FIG. 6, first row of rotor blades 304 and second row of rotor blades 306 may both include blades having the same directional orientation. The orientation of both rows may be considered to be forward or backwards (depending on the direction in which rotor 302 is rotated). That is, rotor blades of both rows preferably direct fluid flow into or away from the direction in which rotor 302 is rotated. As shown in FIG. 6, though, blades of second row 306 may be oriented more severely (e.g., may deviate from a radial orientation by a greater angle) than blades of first row 304. Blades of rotor 302 may also be twisted and/or leaned as desired. In addition, second row of rotor blades 306 preferably includes more rotor blades than first row of rotor blades 304.

Figure 7:
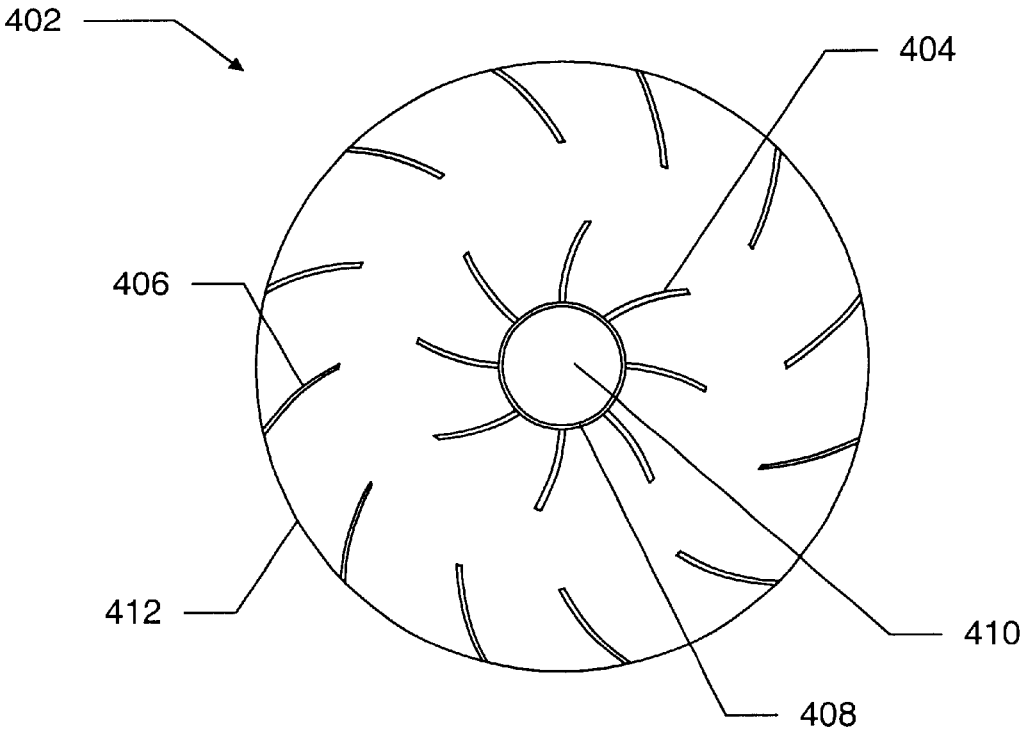
FIG. 7 is a top view of a rotor having a first row and a second row of rotor blades, in which the first and second row of rotor blades are oriented in different and opposite rotational orientations in accordance with another embodiment.

FIG. 7 presents a top view of a rotor 402 in accordance with another embodiment. Rotor 402 preferably includes a first row of rotor blades 404 and a second row of rotor blades 406. Rotor 402 may also include a hub 408 configured to receive a shaft for rotating rotor 402. Hub 408 may include an opening 410 through which the shaft may extend. Thus, the rotational axis of rotor 402 during use may extend through the center of hub 408. Hub 408 may protrude from a base of rotor 402 (e.g., the bottommost portion of the rotor), and preferably widens as it approaches the rotor base, terminating at rotor tip 412. Components shown in FIG. 7 having similar reference numerals as components shown in FIG. 1*a* may be constructed similarly, may perform in a similar manner, and may be operated in a similar manner as their counterpart components from FIG. 1*a* (e.g., hub 408 may function similarly to hub 108, and first row of rotor blades 404 may be composed of the same materials as first row of rotor blades 104). Appropriate modifications may be made, however, to the design, function, and/or operation of each element in accordance with the particular conditions of the relevant embodiment, at least some of which are described below.

As shown in FIG. 7, first row of rotor blades 404 and second row of rotor blades 406 may include blades having different and opposite directional orientations. That is, the orientation of first row of rotor blades 404 may be forwards while the orientation of second row of rotor blades 406 may be backwards, or vice versa (depending on the direction in which rotor 402 is rotated). As such, rotor blades of each row may direct fluid flow in opposite directions in relation to the direction in which rotor 402 is rotated. Even so, blades of second row 406 may be oriented more severely (e.g., may deviate from a radial orientation by a greater absolute angle) than blades of first row 404. Blades of rotor 402 may also be twisted and/or leaned as desired. In addition, second row of rotor blades 406 preferably includes more rotor blades than first row of rotor blades 404.

Figure 8:
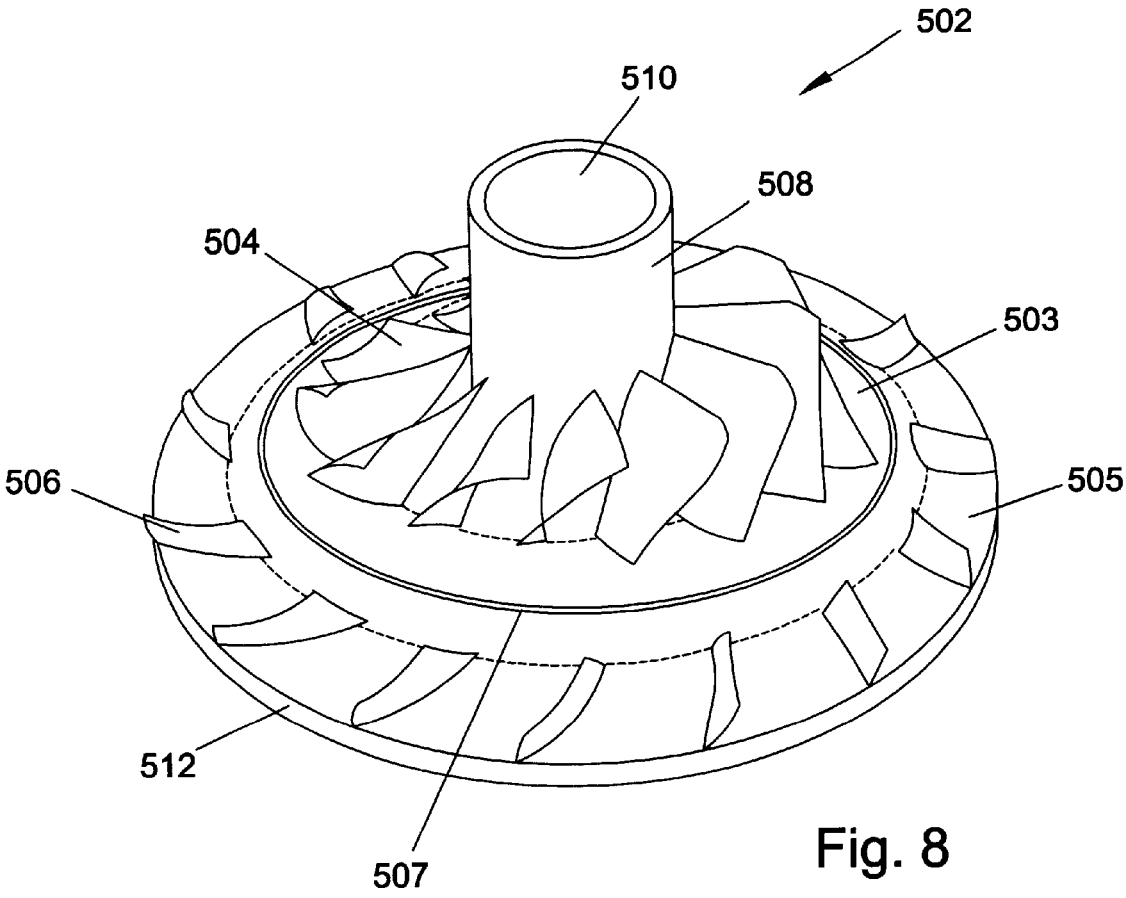
FIG. 8 is a perspective view of a rotor in accordance with another embodiment, in which the rotor is a rotor assembly having an first rotor and a second rotor configured to independently rotate, where the first rotor is positioned within the lateral boundaries of the second rotor.

FIG. 8 presents a perspective view of a rotor, and more specifically of dual rotor assembly 502. Rotor assembly 502 preferably includes a first rotor 503 and a second rotor 505 configured to independently rotate. First rotor 503 and second rotor 505 may be separated by a gap 507. First rotor 503 may include a first row of rotor blades 504. Second rotor 505 may include a second row of rotor blades 506. Second rotor 505 preferably has a larger diameter than first rotor 503. As shown in FIG. 8, first rotor 503 may be positionable at least partially within the lateral boundaries of second rotor 505 such that first row of rotor blades 504 are radially spaced from second row of rotor blades 506. Preferably, first rotor 503 is positioned within an opening defined in a center portion of second rotor 505. Rotor assembly 502 may include a hub configured to receive a shaft for rotating at least a portion of the rotor assembly. In a preferred embodiment, rotor assembly 502 may include a hub 508 for rotating at least first rotor 503. Hub 508 may include an opening 510 through which the shaft may extend. Second rotor 505 may be coupled to a different shaft from that to which first rotor 503 is coupled (see, e.g., FIG. 10). While the first and second rotors may be driven by different shafts, they preferably share the same rotational axis. As such, the rotational axis of rotor assembly 502 during use may extend through the center of hub 508. Hub 508 may protrude from a base of rotor assembly 502 (e.g., the bottommost portion of the rotor assembly), and preferably widens as it approaches the rotor base (and thus may include portions of both the first and second rotors), terminating at rotor assembly tip 512. Components shown in FIG. 8 having similar reference numerals as components shown in FIG. 1*a* may be constructed similarly, may perform in a similar manner, and may be operated in a similar manner as their counterpart components from FIG. 1*a* (e.g., hub 508 may function similarly to hub 108, and first row of rotor blades 504 may be composed of the same materials as first row of rotor blades 104). Appropriate modifications may be made, however, to the design, function, and/or operation of each element in accordance with the particular conditions of the relevant embodiment, at least some of which are described below.

As noted above, a fluid flow controller including rotor assembly 502 may have several advantages. In addition to the features and benefits of the embodiments described above, dual rotor assembly 502 may allow the rotational speed of the rotor blades on each rotor to be independently set to a speed dependent on the specific needs of that row. For example, second rotor 505 may be rotated at a lower speed than first rotor 503, potentially improving the efficiency of the fluid flow controller in which rotor assembly 502 is used. In addition, first rotor 503 and second rotor 505 may be rotated in opposite directions.

When configured for operation (e.g., first rotor 503 is arranged within the lateral boundaries of second rotor 505) first and second rows of rotor blades 504 and 506 each may include several truncated and radially spaced rotor blades. That is, the blades of the first and second rows of rotor blades preferably do not extend the length of rotor assembly 502 (e.g., from hub 508 to tip 512) as do many conventional blades, but instead each extend to radially spaced points along the rotor assembly. Thus, second row of rotor blades 506 may be spaced further away from the center of hub 508 along the radius of rotor assembly 502 than first row of rotor blades 504. The radial spacing between the rows of rotor blades is preferably significant. In an embodiment, the radial spacing between rows is at least one-third to one-half of the length of blades of either row of rotor blades. Such spacing may ensure sufficient spacing for an appropriately sized casing blade to pass between first row 504 and second row 506 during rotation of rotor assembly 502 relative to, and preferably within, a casing. (However, rotor assembly 502 is not required to be used with a casing having a casing blade as described herein.) Preferably first rotor 503 and second rotor 505 are both circular, and thus rotor blades of both rows of rotor blades may extend around a respective rotor in a circular arrangement.

As shown in FIG. 8, blades of first row of rotor blades 504 are preferably arranged closer to the center of hub 508 than blades of second row of rotor blades 506. Additionally, blades of rotor assembly 502 may generally be significantly thinner than they are tall. Furthermore, blades of rotor assembly 502 may be twisted, leaned, and/or rotationally oriented in accordance with the desired performance results for rotor assembly 502 (and possibly taking account the shape of the casing and casing blades it may be used with). There is no required length or size relationship between blades of either row.

Rotor assembly 502 may be a centrifugal rotor assembly for use in a centrifugal pump or compressor. Thus, rotor assembly 502 is preferably configured to accelerate fluid flow such that the predominant orientation of fluid flow exiting the rotor assembly during use is angled away from and substantially oblique to the rotational axis of rotor assembly 502. That is, the majority of fluid flow exiting rotor assembly 502 during use may have an orientation angled away from the rotational axis of the rotor assembly by an amount greater than 5, and preferably greater than 10, degrees. More preferably, rotor assembly 502 may be configured to accelerate fluid flow such that the predominant orientation of fluid flow exiting the rotor assembly during use is substantially perpendicular to the rotational axis of the rotor assembly (e.g., within 10, and preferably 5, degrees of perpendicular).

To achieve the flow characteristics described above, first rotor 503 and second rotor 505 of rotor assembly 502 are preferably shaped such that the diameter of hub 508 increases significantly from the top of hub 508 to the rotor assembly base. (It should be noted that hub 508 may extend from the rotor assembly base significantly further than is shown in FIG. 8.) Consequently, hub 508 may have a sloped or curved surface beneath rotor blades 504 and 506 that, when travelling from a point near the center of hub 508 through gap 507 to rotor assembly tip 512, starts in a orientation substantially parallel to the rotational axis of the rotor assembly, and ends in a orientation substantially perpendicular to the rotational axis of rotor assembly 502. Accordingly, each of rotor blades 504 and 506 includes, in an embodiment, an outer end and an inner end arranged radially closer to the center of the hub than the outer end. Rotor assembly 502 may thus be configured such that a diameter of second rotor 505 at a point proximal to the inner ends of the second row of rotor blades 506 is greater than a diameter of the first rotor 503 proximal to the inner ends of the first row of rotor blades 504. More preferably, a diameter of first rotor 503 at a point proximal to the inner ends of blades of first row of rotor blades 504 may be less than a diameter of first rotor 503 at a point proximal to the respective outer ends of blades of first row of rotor blades 504. Further, a diameter of second rotor 505 at a point proximal to the inner ends of blades of second row of rotor blades 506 may be less than a diameter of second rotor 505 at a point proximal to the outer ends of blades of second row of rotor blades 506. In addition, a diameter of second rotor 505 proximal to midpoints of each of second row of rotor blades 506 may be greater than a diameter of first rotor 503 proximal to midpoints of each of first row of rotor blades 504.

As with rotor 102, blades of first row of rotor blades 504 may be alignable with blades of second row of rotor blades 506 in the shape of a conventional full-length blade from which a central section is removed. The benefits of such a configuration may be similar to those described above. However, there is no requirement for any specific and consistent relationship to exist between individual blades of each row of rotor assembly 502, and there may be more or fewer blades in any row than in any other row.

Figure 9:
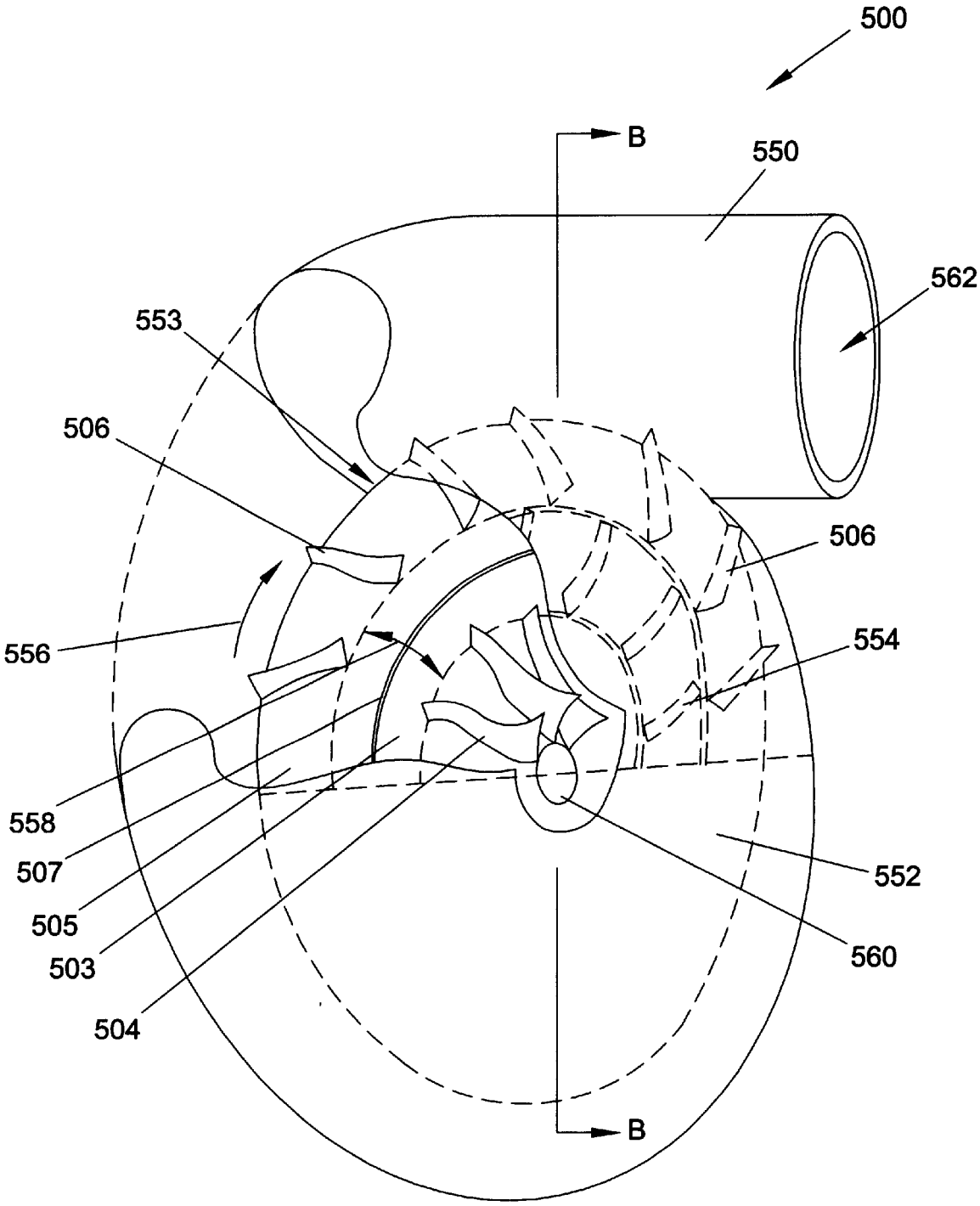
FIG. 9 is a cut-away partial perspective view of a fluid flow controller, in which a rotor as shown in FIG. 8 is positioned within a volute as shown in FIG. 2, the volute including a casing in which the rotor may rotate.

FIG. 9 is a cut-away partial perspective view of a fluid flow controller 500. Fluid flow controller 500 may include a centrifugal compressor having rotor assembly 502 positioned within casing 552 of volute 550. Casing 552 may have at least one casing blade, and preferably has several casing blades 554. Casing blades preferably extend from an inner surface of casing 552 in a circular arrangement. Components shown in FIG. 9 having similar reference numerals as components shown in FIG. 3 may be constructed similarly, may perform in a similar manner, and may be operated in a similar manner as their counterpart components from FIG. 3 (e.g., volute 550 may function similarly to volute 150, and first row of rotor blades 504 may be composed of the same materials as first row of rotor blades 104). Appropriate modifications may be made, however, to the design, function, and/or operation of each element in accordance with the particular conditions of the relevant embodiment, at least some of which are described below.

Rotor assembly 502 is preferably configured to rotate within casing 552 in rotational direction 556 around a rotational axis extending entirely through hub 508. As noted above, rotor assembly 502 may include first rotor 503 spaced by gap 507 from second rotor 505, with both rotors being configured to independently rotate. FIG. 9 illustrates a radial spacing 558 between first row of rotor blades 504 and second row of rotor blades 506. Casing blades 554 are preferably truncated blades having a length less than radial spacing 558 such that the casing blades may freely pass between the first and second rows of rotor blades during rotation of rotor assembly 502 (e.g., at least one of the first and second rotors) within casing 552. Accordingly, casing blades 554 may be located within the circumference (i.e., within the lateral boundaries of) rotor assembly 502.

First and second rows of rotor blades 504 and 506 may be further configured to turn and accelerate fluid flow. Casing blades 554 may also be configured to turn and accelerate fluid flow. (Alternately, however, either row of rotor blades and/or the casing blades may be configured to decelerate fluid flow, to potentially increase the fraction of the overall pressure rise that occurs in a particular section of the rotor/casing assembly.) Beneficially, each blade of fluid flow controller 500, whether on casing 552 or rotor assembly 502, may be configured specifically for the flow characteristics it is expected to encounter during operation. Further, instead of having to be turned by, and thus follow, one long, continuous blade over its entire length, fluid flow may be turned by several discrete blades in series. As a result of the presence of casing blades 554, the velocity of fluid flow leaving blades of first row of rotor blades 504 may have no necessary relationship to the velocity of fluid flow entering second row of rotor blades 506 (e.g., casing blades 554 may turn fluid flow to a different direction and/or velocity than it had leaving first row of rotor blades 504). Thus, the orientation of blades of second row of rotor blades 506 may not be limited by the orientation of blades of first row of rotor blades 504. By configuring the rotor and casing blades appropriately, the sum acceleration imparted by the series of rotor and casing blades may be significantly greater than that provided by a single continuous blade.

Fluid flow controller 500 also includes a casing entrance 560 (e.g., an eye) to allow fluid flow to be introduced into casing 552. Casing entrance 560 may be an opening in casing 552 defined above the center of hub 508. Several fluid flow paths may be defined between the casing and rotor assembly from casing entrance 560 to volute passageway entrances 553. At least one of these fluid flow paths may be substantially parallel to the axis of rotation of rotor assembly 502 at the inlet of the fluid flow path and substantially perpendicular to the axis of rotation of rotor assembly 502 at the outlet of the fluid flow path. The inlet of the fluid flow path may be casing entrance 560, and the outlet of the fluid flow path may be located near rotor assembly tip 512. At the outlet of the fluid flow path, the accelerated and/or compressed fluid may have a substantially radial, or centrifugal, orientation.

During use, fluid flow may be introduced into casing 552 through casing opening 560. Rotor assembly 502 may be rotated to accelerate the fluid flow. That is, at least one of first rotor 503 and second rotor 505 may be rotated within casing 552 to accelerate fluid flow. (Rotation of rotor assembly 502 may be initiated before or after introduction of fluid flow into casing 552.) Rotor assembly 502 is preferably rotated such that each of casing blades 554 pass between first row of rotor blades 504 on first rotor 503 and second row of rotor blades 506 on second rotor 505. First rotor 503 and second rotor 505 may be rotated at different speeds, and possibly in different directions.

In an embodiment, the entering fluid flow may thus be turned by a first rotor blade from first row of rotor blades 504, then by a casing blade from casing blades 554, and then finally by a second rotor blade from second row of rotor blades 506. As noted above, the amount of acceleration and/or compression imparted to a fluid passing through the rotor/casing assembly of fluid flow controller 500 may consequently be much higher than is conventionally possible.

Because of the design of rotor assembly 502 described above, rotation of rotor assembly 502 in rotational direction 556 may accelerate fluid flow such that the predominant orientation of the fluid flow exiting rotor assembly 502 is substantially oblique to the rotational axis of the rotor assembly. More preferably, rotation of rotor assembly 502 in rotational direction 556 may accelerate fluid flow such that the predominant orientation of the fluid flow exiting rotor assembly 502 is substantially perpendicular to the rotational axis of the rotor assembly. Rotation of rotor assembly 502 may be imparted by one or more shafts (e.g., inner shaft 570 and outer shaft 572 shown in FIG. 10) coupled to first rotor 503 and second rotor 505, respectively, with at least one shaft extending through hub 508.

Fluid flow exiting rotor assembly 502 may enter volute 550 through volute passageway entrances 553. Volute 550 is only partially shown in FIG. 9, and thus fluid flow may exit through opening 562 (which may exist only as a cross-section of volute 550) into the remaining portions of the volute. It should be noted that fluid flow controller 500 may be configured such that the pressure rise imparted to fluid flow may be divided between each row of blades (rotor and casing) and the volute as desired.

Figure 10:
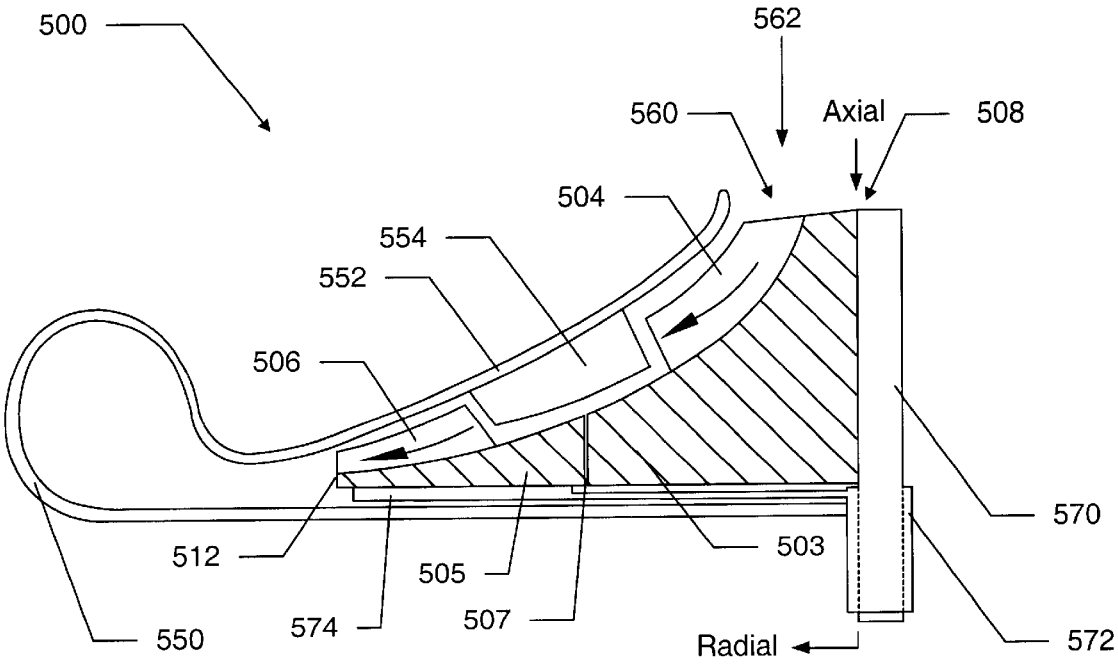
FIG. 10 is a partial cross-sectional view along axis B of the fluid flow controller shown in FIG. 9, in which a casing blade is shown closely positioned between first and second spaced rotor blades during use.

FIG. 10 presents a partial cross-sectional view along axis B of fluid flow controller 500. As shown in FIG. 10, casing blades 554 may be closely positioned between blades of first row of rotor blades 504 arranged on first rotor 503 and blades of second row of rotor blades 506 arranged on second rotor 505 during use. Consequently, the spacing between casing blades 554 and rotor blades 504 and 506, and between casing blades 554 and the surface of rotor assembly 502, as a casing blade passes between the first and second row of rotor blades may be relatively small. In an embodiment, the spacing between the casing blades and the rotor assembly surface (e.g., the surface of the first and second rotors) may be approximately equivalent to the spacing between the rotor blades and the casing surface from which the casing blades extend. Stated otherwise, rotor assembly 502 is preferably positionable within casing 552 such that casing blades 554 extend laterally between first and second rows of rotor blades 504 and 506 to a point proximal to the surface of rotor assembly 502 during rotation of the rotor assembly within the casing. In an embodiment, casing blades 554 may extend to a point spaced from the rotor assembly surface less than one-fourth the height of blades of either row of rotor blades.

As shown in FIG. 10, rotor assembly 500 may also include inner shaft 570 and outer shaft 572. Inner shaft 570 and outer shaft 572 may be concentrical shafts having a common rotational axis and capable of rotating independently (e.g., at different speeds and times, and in possibly different directions). Outer shaft 572 may extend around at least a portion of inner shaft 570. Inner shaft 570 may attached to an inner surface of hub 508. Inner shaft 570 may impart rotation to first rotor 503 around a rotational axis extending through the center of inner shaft 570, and thus preferably through the center of hub 508. Outer shaft 572 may be coupled to second rotor 505 through outer shaft connecting element 574. Gutter shaft connecting element 574 may be coupled to the outer surface of outer shaft 572 and may extend between rotor assembly 502 and casing 552 to the bottom of second rotor 505.

As noted in relation to FIG. 9, fluid flow 562 may be introduced into casing 552 through entrance 560 during use. Fluid flow 562 may travel along a fluid flow path between casing 552 and rotor assembly 502. The fluid flow path may have an inlet above casing entrance 560 and may have an outlet near rotor assembly tip 512 and proximal to one of volute entrances 553 of volute 550. The fluid flow path for fluid flow 562 may be substantially parallel to the rotational axis of rotor assembly 502 at the inlet of the fluid flow path (e.g., in an "Axial" direction as shown in FIG. 10) and substantially perpendicular to the rotational axis of rotor assembly 502 at the outlet of the fluid flow path (e.g., in a "Radial" direction as shown in FIG. 10). Consequently, fluid flow 562 exiting over tip 512 of rotor assembly 502 may have a substantially radial, or centrifugal, orientation.

Figure 11A:
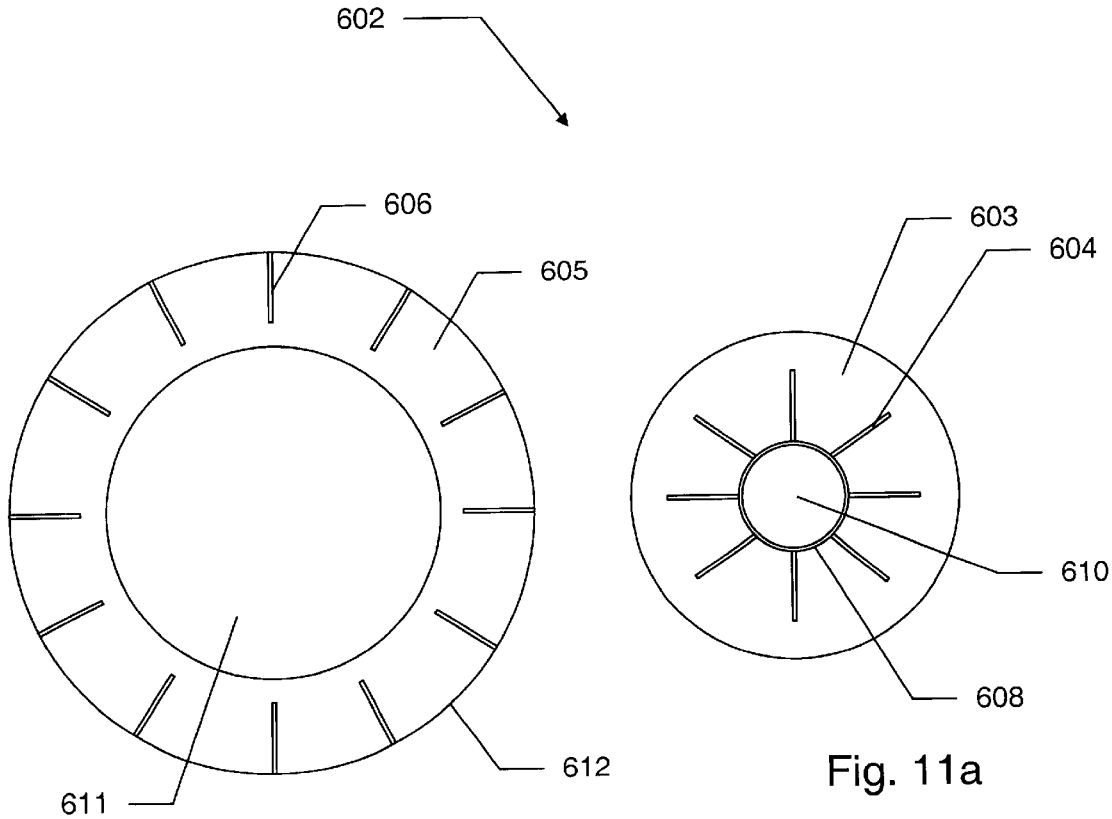
FIG. 11*a* is a top view of an unassembled rotor assembly having an first rotor and a second rotor configured to independently rotate in accordance with another embodiment.

FIG. 11*a* presents a top view of an unassembled dual rotor assembly 602 in accordance with another embodiment. Rotor assembly 602 preferably includes a first rotor 603 and a second rotor 605 configured to independently rotate. First rotor 603 may include a first row of rotor blades 604. Second rotor 605 may include a second row of rotor blades 606. Second rotor 605 preferably has a larger diameter than first rotor 603. Rotor assembly 602 may include a hub 608 for rotating at least first rotor 603. Hub 608 may include an opening 610 through which the shaft may extend. An opening 611 may be defined in a center portion of second rotor 605, into which first rotor 603 is positionable. Components shown in FIGS. 11*a* and 11*b* having similar reference numerals as components shown in FIG. 8 may be constructed similarly, may perform in a similar manner, and may be operated in a similar manner as their counterpart components from FIG. 8 (e.g., hub 608 may function similarly to hub 508, and first row of rotor blades 604 may be composed of the same materials as first row of rotor blades 504). Appropriate modifications may be made, however, to the design, function, and/or operation of each element in accordance with the particular conditions of the relevant embodiment, at least some of which are described below.

As shown in FIG. 11*a*, first row of rotor blades 604 and second row of rotor blades 606 may both include blades having a radial orientation. That is, rotor blades of both rows preferably direct fluid flow substantially along the radius of rotor assembly 602 (when assembled) and not significantly into or away from the direction in which rotor assembly 602 is rotated. Each of the blades of first and second rows of rotor blades 604 and 606 may have the same rotational orientation. That is, while the blades of either row are not required to have the precisely same degree of rotational orientation, they do preferably have the same general rotational orientation. Blades of rotor assembly 602 may also be twisted and/or leaned as desired. In addition, second row of rotor blades 606 preferably includes more rotor blades than first row of rotor blades 604.

Figure 11B:
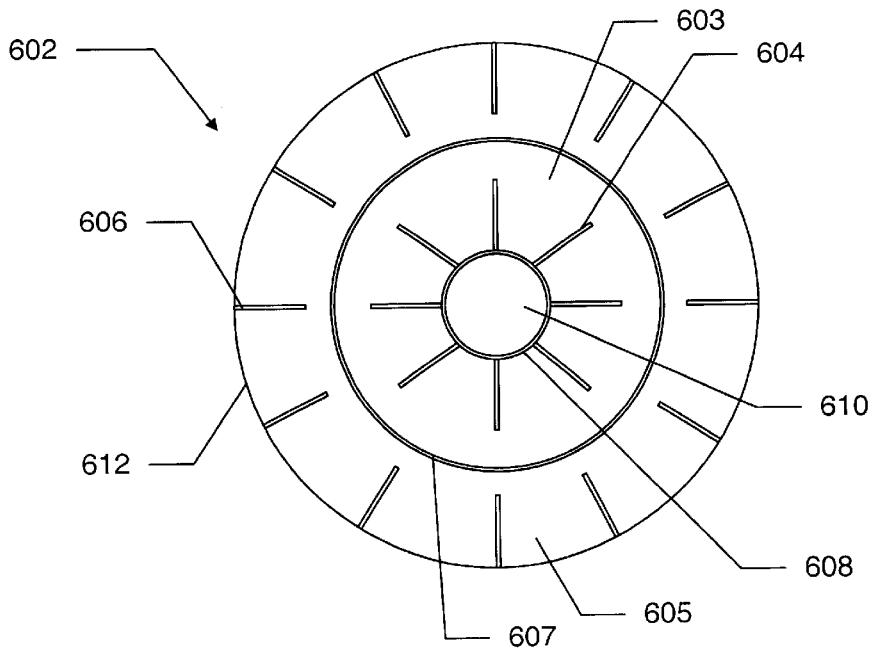
FIG. 11*b* is a top view of the rotor assembly of FIG. 11*a*, in which the first rotor is positioned within the lateral dimensions of the second rotor.

FIG. 11*b* presents a top view of rotor assembly 602, in which first rotor 603 is positioned within the lateral dimensions of second rotor 605. Preferably, first rotor 603 is preferably at least partially positioned within opening 611 of second rotor 605 such that first row of rotor blades 604 are radially spaced from second row of rotor blades 606. When assembled, first rotor 603 and second rotor 605 may be separated by gap 607.

Figure 12:
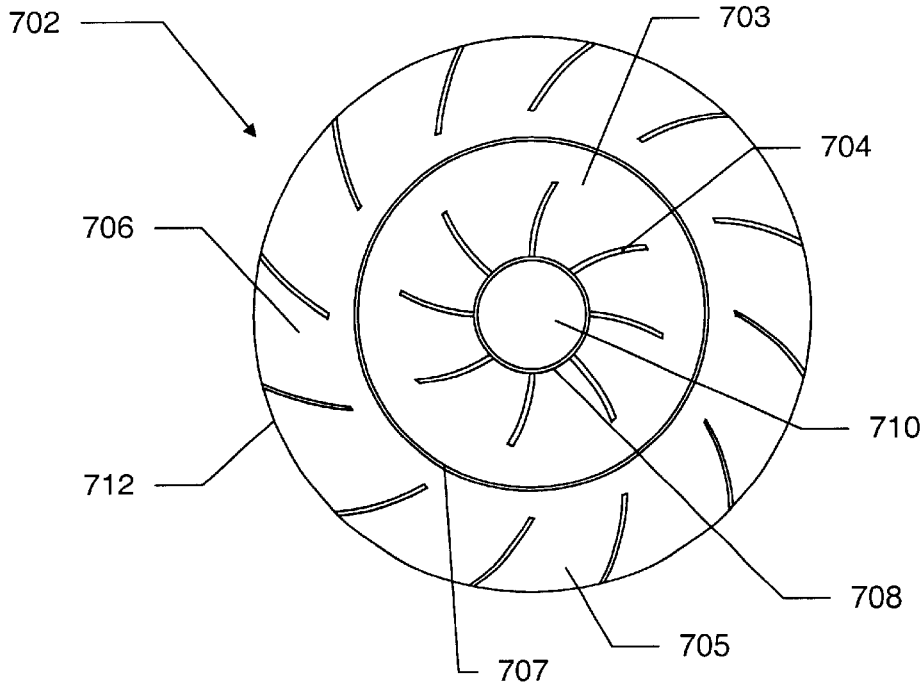
FIG. 12 is a top view of a rotor assembly having an first rotor and a second rotor configured to independently rotate, in which the first row of rotor blades of the first rotor and the second row of rotor blades of the second rotor are oriented in the same rotational orientation in accordance with another embodiment.

FIG. 12 presents a top view of a dual rotor assembly 702 in accordance with another embodiment. Rotor assembly 702 preferably includes a first rotor 703 and a second rotor 705 configured to independently rotate. First rotor 703 and second rotor 705 may be separated by gap 707. First rotor 703 may include a first row of rotor blades 704. Second rotor 705 may include a second row of rotor blades 706. Second rotor 705 preferably has a larger diameter than first rotor 703. First rotor 703 may be positioned within the lateral dimensions of second rotor 705. Preferably, first rotor 703 is preferably at least partially positioned within an opening defined within second rotor 705 such that first row of rotor blades 704 are radially spaced from second row of rotor blades 706. Rotor assembly 702 may include a hub 708 for rotating at least first rotor 703. Hub 708 may include an opening 710 through which the shaft may extend. Components shown in FIG. 12 having similar reference numerals as components shown in FIG. 8 may be constructed similarly, may perform in a similar manner, and may be operated in a similar manner as their counterpart components from FIG. 8 (e.g., hub 708 may function similarly to hub 508, and first row of rotor blades 704 may be composed of the same materials as first row of rotor blades 504). Appropriate modifications may be made, however, to the design, function, and/or operation of each element in accordance with the particular conditions of the relevant embodiment, at least some of which are described below.

As shown in FIG. 12, first row of rotor blades 704 and a second row rotor blades 706 may both include blades having the same directional orientation. The orientation of both blade rows may be considered forward or backwards (depending on the direction in which rotor assembly 702 is rotated). That is, rotor blades of both rows preferably direct fluid flow into or away from the direction in which rotor assembly 702 is rotated (assuming both rotors are rotated in the same direction). As shown in FIG. 12, though, blades of second row 706 may be oriented more severely (e.g., may deviate from a radial orientation by a greater angle) than blades of first row 704. Blades of rotor 702 may also be twisted and/or leaned as desired. In addition, second row of rotor blades 706 preferably includes more rotor blades than first row of rotor blades 704.

Figure 13:
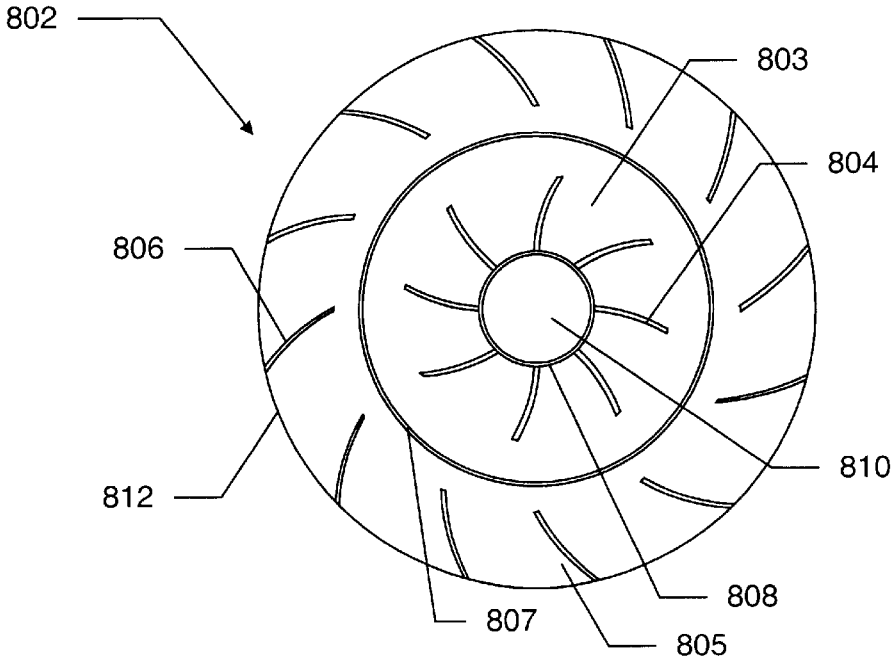
FIG. 13 is a top view of a rotor assembly having an first rotor and a second rotor configured to independently rotate, in which the first row of rotor blades of the first rotor and the second row of rotor blades of the second rotor are oriented in different and opposite rotational orientations in accordance with another embodiment.

FIG. 13 presents a top view of a dual rotor assembly 802 in accordance with another embodiment. Rotor assembly 802 preferably includes a first rotor 803 and a second rotor 805 configured to independently rotate. First rotor 803 and second rotor 805 may be separated by gap 807. First rotor 803 may include a first row of rotor blades 804. Second rotor 805 may include a second row of rotor blades 806. Second rotor 805 preferably has a larger diameter than first rotor 803. First rotor 803 may be positioned within the lateral dimensions of second rotor 805. Preferably, first rotor 803 is preferably at least partially positioned within an opening defined within second rotor 805 such that first row of rotor blades 804 are radially spaced from second row of rotor blades 806. Rotor assembly 802 may include a hub 808 for rotating at least first rotor 803. Hub 808 may include an opening 810 through which the shaft may extend. Components shown in FIG. 12 having similar reference numerals as components shown in FIG. 8 may be constructed similarly, may perform in a similar manner, and may be operated in a similar manner as their counterpart components from FIG. 8 (e.g., hub 808 may function similarly to hub 508, and first row of rotor blades 804 may be composed of the same materials as first row of rotor blades 504). Appropriate modifications may be made, however, to the design, function, and/or operation of each element in accordance with the particular conditions of the relevant embodiment, at least some of which are described below.

As shown in FIG. 13, first row of rotor blades 804 and second row of rotor blades 806 may include blades having different and opposite directional orientations. That is, the orientation of first row of rotor blades 804 may be forwards while the orientation of second row of rotor blades 806 may be backwards, or vice versa (depending on the direction in which rotor assembly 802 is rotated). As such, rotor blades of each row may direct fluid flow in opposite directions in relation to the direction in which rotor assembly 802 is rotated (assuming both rotors are rotated in the same direction). Even so, blades of second row 806 may be oriented more severely (e.g., may deviate from a radial orientation by a greater absolute angle) than blades of first row 804. Blades of rotor 802 may also be twisted and/or leaned as desired. In addition, second row of rotor blades 806 preferably includes more rotor blades than first row of rotor blades 804.

The construction of a fluid flow controller as outlined above will be apparent to those skilled in the art having the benefit of this disclosure. The materials of which the fluid flow controller may be constructed may include metals, plastics, ceramics, and combinations thereof. In an alternative embodiment, the casing and/or rotor may be composed of a self-contouring or deformable material. For example, rotor blades could be constructed such that they would initially contact the casing inner surface during use. Then, the rotation of the rotor, and the accompanying pressure against the casing applied by the rotor blades, could deform the casing inner surface to a shape that would allow the rotor to freely rotate within the casing (e.g., by removing excess material from the casing inner surface). Such a material could allow for absolute minimum tolerances between a rotor and casing, which may increase the efficiency of the fluid flow controller.

In other alternative embodiments, the blades on the casing and rotor may be configured such as to be mechanically adjustable. Thus, the orientation of the blades may be altered, e.g., during use, in order to adjust for changing process parameters. For example, the fluid flow controller could be configured such that the orientation, lean, etc., of the casing and/or rotor blades could be changed in accordance with changes in the speed or temperature of the entering fluid, possibly by using process control routines. In a further embodiment, the casing blades may not be stationary as described above, but may instead be configured to rotate relative a rotor positioned within. Additionally, because of the greater efficiency of the present fluid flow controller, the need to use a gearbox to reduce the shaft speed when the shaft for the rotor is coupled to, e.g., the shaft of a turbine may be eliminated. Consequently, the rotor may be mounted on the same shaft (e.g., on a common shaft) as a turbine. (It should be noted that as used herein, the articles "a" or "an" may encompass one or more of the referenced element.)

It will be appreciated by those skilled in the art having the benefit of this disclosure that this invention is believed to provide an improved fluid flow controller and method for operation thereof. Compared to conventional pumps or compressors, the present fluid flow controller may have an enhanced ability to accelerate (and possibly to subsequently pressurize) fluid flow. By allowing for a significant increase in the number of discrete rotor blades on the rotor and casing, the fluid flow controller may provide greater fluid flow acceleration. Beneficially, such increased acceleration may reduce or avoid the need to resort to multiple stage designs when, e.g., very large pressure rises are desired.

Further modifications and alternative embodiments of various aspects of the invention may be apparent to those skilled in the art in view of this disclosure. For example, the rotor may include more than two rotor blade rows, and the casing may include more than one casing blade row. Thus, in a dual rotor embodiment, a rotor assembly could include three or more independently rotatable rotors each having a row of rotor blades. Further, the opening for receiving a shaft in a rotor hub is not required to extend entirely through the hub, or into the hub at all. Further, the rotor and casing may be usable as a centrifugal stage in an axial-centrifugal rotor. Further, the present fluid flow controller is not required to be a single stage controller, but may include multiple stages of similarly configured rotors and casings, possibly arranged in series. Further, the shape of the rotor and casing blades, the casing, the rotor, the volute, and other potential components of the present fluid flow controller may be varied as desired. Further, the fluid flow controller may be used to control (e.g. pump or compress) a variety of fluids, including liquids, gases, and combinations thereof, in a variety of applications, including turbochargers, air conditioning compressors, jet engines, and appliances such as dishwashers and refrigerators.

Accordingly, this description is to be construed as illustrative only and is for teaching those skilled in the art the general manner of carrying out the invention. This disclosure is not to be regarded in a restrictive sense. It is to be understood that the forms of the invention shown and described herein are to be taken as presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A fluid flow controller comprising a casing having a casing blade configured to pass between a first plurality of rotor blades and a second plurality of rotor blades radially spaced from the first plurality of rotor blades, wherein the first and second plurality of rotor blades are of a rotor adapted to rotate relative to the casing, and wherein the second plurality of rotor blades comprise more rotor blades than the first plurality of rotor blades.

2. The fluid flow controller of claim 1, wherein the casing blade is one of a plurality of casing blades.

3. The fluid flow controller of claim 2, wherein the plurality of casing blades extends from an inner surface of the casing in a circular arrangement.

4. The fluid flow controller of claim 1, wherein the rotor is configured to accelerate fluid flow such that the predominant orientation of fluid flow exiting the rotor during use is angled away from and substantially oblique to the rotational axis of the rotor.

5. The fluid flow controller of claim 4, wherein the rotor is configured to accelerate fluid flow such that the predominant orientation of fluid flow exiting the rotor during use is angled away from and substantially perpendicular to the rotational axis of the rotor.

6. A fluid flow controller, comprising:

a centrifugal rotor of a centrifugal pump or compressor adapted for rotation, and comprising a first rotor blade and a second rotor blade radially spaced from the first rotor blade; and a casing comprising a casing blade configured to pass between the first rotor blade and the second rotor blade during rotation of the rotor relative to the casing.

7. The fluid flow controller of claim 6, wherein the rotor is configured to accelerate fluid flow such that the predominant orientation of fluid flow exiting the rotor during use is angled away from and substantially oblique to the rotational axis of the rotor.

8. The fluid flow controller of claim 7, wherein the rotor is configured to accelerate fluid flow such that the predominant orientation of fluid flow exiting the rotor during use is substantially perpendicular to the rotational axis of the rotor.

9. The fluid flow controller of claim 6, wherein the rotor comprises a hub configured to receive a shaft for rotating the rotor, and wherein the first rotor blade is arranged closer to the center of the hub than the second rotor blade.

10. The fluid flow controller of claim 9, wherein the first and second rotor blades each comprise an outer end and an inner end closer to the center of the hub than the outer end, and wherein a diameter of the rotor at a point proximal to the inner end of the second rotor blade is greater than a diameter of the rotor proximal to the inner end of the first rotor blade.

11. The fluid flow controller of claim 10, wherein a diameter of the rotor at a point proximal to the inner end of the first rotor blade is less than a diameter of the rotor at a point proximal to the outer end of the first rotor blade, and wherein a diameter of the rotor at a point proximal to the inner end of the second rotor blade is less than a diameter of the rotor at a point proximal to the outer end of the second rotor blade.

12. The fluid flow controller of claim 6, wherein the rotor further comprises a first plurality of rotor blades including the first rotor blade and a second plurality of rotor blades including the second rotor blade, and wherein the casing blade is further configured to pass between the first plurality of rotor blades and the second plurality of rotor blades during rotation of the rotor relative to the casing.

13. The fluid flow controller of claim 12, wherein the casing further comprises a plurality of casing blades including the casing blade, and wherein each of the plurality of casing blades is configured to pass between the first plurality of rotor blades and the second plurality of rotor blades during rotation of the rotor relative to the casing.

14. The fluid flow controller of claim 13, wherein the first plurality of rotor blades is closer to the center of a hub of the rotor than the second plurality of rotor blades, and wherein the second plurality of rotor blades comprises more rotor blades than the first plurality of rotor blades.

15. The fluid flow controller of claim 6, wherein the rotor is positionable within the casing such that the casing blade extends laterally between the first and second rotor blades to a point proximal to the surface of the rotor during rotation of the rotor within the casing.

16. The fluid flow controller of claim 6, wherein the radial spacing between the first rotor blade and the second rotor blade is at least one-half the length of either rotor blade.

17. The fluid flow controller of claim 6, wherein the rotor is a rotor assembly comprising a first rotor including the first rotor blade and a second rotor including the second rotor blade and having a diameter greater than the first rotor, and wherein the first rotor and the second rotor are configured to independently rotate during use.

18. A fluid flow controller, comprising:

a rotor configured to rotate around a rotational axis extending through a hub of the rotor, the rotor comprising a first plurality of rotor blades and a second plurality of rotor blades radially spaced from the first plurality of rotor blades and arranged further from the center of the hub than the first plurality of rotor blades, wherein a diameter of the rotor proximal to midpoints of each of the second plurality of rotor blades is greater than a diameter of the rotor proximal to midpoints of each of the first plurality of rotor blades, and wherein the rotor is configured to accelerate fluid flow such that the predominant orientation of fluid flow exiting the rotor during use is angled away from and substantially oblique to the rotational axis of the rotor;

a casing comprising a plurality of casing blades configured to pass between the first plurality of rotor blades and the second plurality of rotor blades during rotation of the rotor within the casing; and wherein the rotor is positioned within the casing such that each of the plurality of casing blades extends between ones of the first and second pluralities of rotor blades to a point proximal to the surface of the rotor during rotation of the rotor within the casing.

19. The fluid flow controller of claim 18, wherein the rotor is configured to accelerate fluid flow such that the predominant orientation of fluid flow exiting the rotor during use is substantially perpendicular to the rotational axis of the rotor.

20. The fluid flow controller of claim 18, wherein the rotor is positionable within the casing such that a fluid flow path is defined between the casing and the rotor, and wherein the fluid flow path is substantially parallel to the axis of rotation of the rotor at an inlet of the fluid flow path and is substantially perpendicular to the axis of rotation of the rotor at an outlet of the fluid flow path.

21. The fluid flow controller of claim 18, wherein each of the first plurality of rotor blades and each of the second plurality of rotor blades are arranged in the same rotational orientation.

22. The fluid flow controller of claim 18, wherein each of the first plurality of rotor blades is arranged in a different rotational orientation from each of the second plurality of rotor blades.

23. The fluid flow controller of claim 18, wherein the second plurality of rotor blades comprises more rotor blades than the first plurality of rotor blades.

24. The fluid flow controller of claim 18, wherein the plurality of casing blades extend from an inner surface of the casing in a circular arrangement, and wherein the first plurality of rotor blades and the second plurality of rotor blades each extend around the rotor in a circular arrangement.

25. A method for operating a fluid flow controller, comprising:

introducing fluid flow into a casing in which a rotor is positioned, wherein the rotor includes a first rotor blade and a second rotor blade radially spaced from the first rotor blade, and wherein the casing includes a casing blade; and rotating the rotor within the casing such that the casing blade passes between the first rotor blade and the second rotor blade, wherein the rotor includes a hub configured to receive a shaft for rotating the rotor, and wherein said rotating the rotor further comprises rotating the rotor around a rotational axis extending through the hub, and wherein the first and second rotor blades each include an outer end and an inner end closer to the center of the hub than the outer end, and wherein a diameter of the rotor at a point proximal to the inner end of the second rotor blade is greater than a diameter of the rotor proximal to the inner end of the first rotor blade.

26. The method of claim 25, further comprising accelerating the fluid flow by said rotating the rotor such that the predominant orientation of the fluid flow exiting the rotor is substantially oblique to the rotational axis of the rotor.

27. The method of claim 26, wherein said accelerating the fluid flow comprises accelerating the fluid flow by said rotating the rotor such that the predominant orientation of the fluid flow exiting the rotor is substantially perpendicular to the rotational axis of the rotor.

28. The method of claim 25, wherein a diameter of the rotor at a point proximal to the inner end of the first rotor blade is less than a diameter of the rotor at a point proximal to the outer end of the first rotor blade, and wherein a diameter of the rotor at a point proximal to the inner end of the second rotor blade is less than a diameter of the rotor at a point proximal to the outer end of the second rotor blade.

29. The method of claim 25, wherein the rotor further includes a first plurality of rotor blades including the first rotor blade and a second plurality of rotor blades including the second rotor blade, and wherein said rotating the rotor further comprises rotating the rotor within the casing such that the casing blade passes between the first plurality of rotor blades and the second plurality of rotor blades.

30. The method of claim 29, wherein the casing further includes a plurality of casing blades including the casing blade, and wherein said rotating the rotor further comprises rotating the rotor within the casing such that each of the plurality of casing blades passes between the first plurality of rotor blades and the second plurality of rotor blades.

31. The method of claim 30, further comprising accelerating the fluid flow by said rotating the rotor such that the predominant orientation of the fluid flow exiting the rotor during use is substantially perpendicular to the rotational axis of the rotor.

32. A fluid flow controller comprising a rotor assembly, the rotor assembly comprising:

a first rotor having a first rotor blade;

a second rotor having a second rotor blade, wherein the first rotor is positionable at least partially within the lateral boundaries of the second rotor such that the first rotor blade is radially spaced from the second rotor blade, and wherein the first and second rotors are configured to independently rotate; and wherein the rotor assembly is configured to accelerate fluid flow such that the predominant orientation of fluid flow exiting the rotor assembly during use is angled away from and substantially oblique to a rotational axis of the rotor assembly.

33. The fluid flow controller of claim 32, wherein the first rotor and the second rotor are configured to rotate at different speeds.

34. The fluid flow controller of claim 33, wherein the first rotor and the second rotor are configured to rotate in opposite directions.

35. The fluid flow controller of claim 33, wherein the rotor assembly is configured to accelerate fluid flow such that the predominant orientation of fluid flow exiting the rotor assembly during use is substantially perpendicular to the rotational axis of the rotor assembly.

36. The fluid flow controller of claim 33, further comprising a casing including a casing blade configured to pass between the first rotor blade and the second rotor blade during rotation of the rotor assembly relative to the casing.

37. The fluid flow controller of claim 36, wherein the first and second rotor blades each comprise an outer end and an inner end closer to the center of a hub of the rotor assembly than the outer end, and wherein a diameter of the second rotor at a point proximal to the inner end of the second rotor blade is greater than a diameter of the first rotor proximal to the inner end of the first rotor blade.

38. The fluid flow controller of claim 37, wherein a diameter of the first rotor at a point proximal to the inner end of the first rotor blade is less than a diameter of the first rotor at a point proximal to the outer end of the first rotor blade, and wherein a diameter of the second rotor at a point proximal to the inner end of the second rotor blade is less than a diameter of the second rotor at a point proximal to the outer end of the second rotor blade.

39. The fluid flow controller of claim 36, wherein the rotor assembly is positionable within the casing such that the casing blade extends laterally between the first and second rotor blades to a point proximal to the surface of the rotor during rotation of the rotor within the casing.

40. A fluid flow controller, comprising:

a rotor assembly configured to rotate around a rotational axis extending through a hub of the rotor assembly, the rotor assembly comprising:

a first rotor having a first plurality of rotor blades;

a second rotor having a second plurality of rotor blades radially spaced from the first plurality of rotor blades and having a diameter greater than the first rotor, wherein the first rotor is positionable at least partially within the lateral boundaries of the second rotor such that the second plurality of rotor blades are radially spaced from the first plurality of rotor blades and arranged further from the center of the hub than the first plurality of rotor blades, and wherein the first and second rotors are configured to independently rotate; and wherein a diameter of the second rotor proximal to midpoints of each of the plurality of second rotor blades is greater than a diameter of the first rotor assembly proximal to midpoints of each of the plurality of first rotor blades, and wherein the rotor assembly is configured to accelerate fluid flow such that the predominant orientation of fluid flow exiting the rotor during use is angled away from and substantially oblique to the rotational axis of the rotor; and a casing comprising a plurality of casing blades configured to pass between the plurality of first rotor blades and the plurality of second rotor blades during rotation of the rotor assembly within the casing.

41. The fluid flow controller of claim 40, wherein the first rotor and the second rotor are configured to rotate at different speeds.

42. The fluid flow controller of claim 41, wherein the first rotor and the second rotor are configured to rotate in opposite directions.

43. The fluid flow controller of claim 41, wherein the rotor assembly is configured to accelerate fluid flow such that the predominant orientation of fluid flow exiting the rotor assembly during use is substantially perpendicular to the rotational axis of the rotor assembly.

44. The fluid flow controller of claim 41, wherein the rotor assembly is positioned within the casing such that a fluid flow path is defined between the casing and the rotor assembly, and wherein the fluid flow path is substantially parallel to the axis of rotation of the rotor assembly at the inlet of the fluid flow path and is substantially perpendicular to the axis of rotation of the rotor assembly at the outlet of the fluid flow path.

45. The fluid flow controller of claim 41, wherein the rotor assembly is positioned within the casing such that each of the plurality of casing blades extends between ones of the first and second plurality of rotor blades to a point proximal to the surface of the rotor during rotation of the rotor within the casing.

46. The fluid flow controller of claim 41, wherein each of the first plurality of rotor blades and each of the second plurality of rotor blades are arranged in the same rotational orientation.

47. The fluid flow controller of claim 41, wherein each of the first plurality of rotor blades is arranged in a different rotational orientation from each of the second plurality of rotor blades.

48. The fluid flow controller of claim 41, wherein the second plurality of rotor blades comprises more rotor blades than the first plurality of rotor blades.

49. The fluid flow controller of claim 41, wherein the second rotor comprises an opening in a central portion thereof, and wherein the first rotor is at least partially positioned within the opening.

50. The fluid flow controller of claim 41, further comprising first and second concentric shafts, wherein the second shaft extends around a portion of the first shaft and is coupled to the second rotor, and wherein the first shaft is coupled to the first rotor.

51. A method for operating a fluid flow controller, comprising:

introducing fluid flow into a casing in which a rotor assembly is positioned, wherein the rotor assembly includes:

a first rotor having a first rotor blade; and a second rotor having a second rotor blade, wherein the first rotor is positioned within the lateral boundaries of the second rotor such that the first rotor blade is radially spaced from the second rotor blade, and wherein the first and second rotors are configured to independently rotate;

rotating the first and second rotors within the casing; and accelerating the fluid flow by said rotating the first and second rotors such that the predominant orientation of the fluid flow exiting the rotor assembly is angled away from and substantially oblique to the rotational axis of the rotor assembly.

52. The method of claim 51, wherein said rotating the first and second rotors comprises rotating the first and second rotors within the casing at different speeds.

53. The method of claim 52, wherein said rotating the first and second rotors further comprises rotating the first and second rotors within the casing in different directions.

54. The method of claim 51, wherein said accelerating the fluid flow comprises accelerating the fluid flow by said rotating the first and second rotors such that the predominant orientation of the fluid flow exiting the rotor assembly is substantially perpendicular to the rotational axis of the rotor assembly.

55. The method of claim 54, wherein the casing comprises a casing blade, and wherein said rotating the first and second rotors comprises rotating the first and second rotors within the casing such that the casing blade passes between the first and second rotor blades.

56. The method of claim 55, wherein the first rotor further includes a first plurality of rotor blades including the first rotor blade and the second rotor further includes a second plurality of rotor blades including the second rotor blade, and wherein said rotating the first and second rotors further comprises rotating the first and second rotors within the casing such that the casing blade passes between the first plurality of rotor blades and the second plurality of rotor blades.

57. The method of claim 56, wherein the casing further includes a plurality of casing blades including the casing blade, and wherein said rotating the first and second rotors further comprises rotating the first and second rotors within the casing such that each of the plurality of casing blades passes between the first plurality of rotor blades and the second plurality of rotor blades.

58. The method of claim 57, further comprising accelerating the fluid flow by said rotating the first and second rotors such that the predominant orientation of the fluid flow exiting the rotor during use is substantially perpendicular to the rotational axis of the rotor.

* * * * *